US009139351B2

(12) United States Patent
Chou et al.

(10) Patent No.: US 9,139,351 B2
(45) Date of Patent: Sep. 22, 2015

(54) TEMPERATURE-STABILIZED STORAGE SYSTEMS WITH FLEXIBLE CONNECTORS

(75) Inventors: Fong-Li Chou, Issaquah, WA (US); Geoffrey F. Deane, Bellevue, WA (US); William Gates, Redmond, WA (US); Zihong Guo, Bellevue, WA (US); Roderick A. Hyde, Redmond, WA (US); Edward K. Y. Jung, Bellevue, WA (US); Nathan P. Myhrvold, Bellevue, WA (US); Nels R. Peterson, Seattle, WA (US); Clarence T. Tegreene, Bellevue, WA (US); Charles Whitmer, North Bend, WA (US); Lowell L. Wood, Jr., Bellevue, WA (US)

(73) Assignee: TOKITAE LLC, Bellevue, WA (US)

( * ) Notice: Subject to any disclaimer, the term of this patent is extended or adjusted under 35 U.S.C. 154(b) by 1121 days.

(21) Appl. No.: 12/927,981

(22) Filed: Nov. 29, 2010

(65) Prior Publication Data

US 2011/0155745 A1 Jun. 30, 2011

Related U.S. Application Data

(63) Continuation-in-part of application No. 12/001,757, filed on Dec. 11, 2007, and a continuation-in-part of application No. 12/006,088, filed on Dec. 27, 2007, now Pat. No. 8,215,518, and a continuation-in-part of (Continued)

(51) Int. Cl.
*B65D 1/24* (2006.01)
*B65D 1/36* (2006.01)
(Continued)

(52) U.S. Cl.
CPC ..... *B65D 81/3806* (2013.01); *A61J 1/00* (2013.01); *A61J 2200/40* (2013.01); *F28D 20/02* (2013.01)

(58) Field of Classification Search
CPC ..... B65D 81/38; B65D 81/3806; B65D 81/3846; B65D 90/48; A47J 41/00; A47J 41/02; F28D 20/02; F25D 23/067; F25D 2201/14; F17C 3/08; F17C 13/001; F17C 2203/016; F17C 2203/018
USPC ..... 220/62.18, 560.12, 592.26, 592.27, 220/506, 918, 919, 592.05
See application file for complete search history.

(56) References Cited

U.S. PATENT DOCUMENTS 520,584 A 5/1894 Turner
1,903,171 A 3/1933 Cordrey
(Continued)

FOREIGN PATENT DOCUMENTS

CN 2414742 Y 1/2001
CN 2460457 Y 11/2001
(Continued)

OTHER PUBLICATIONS

U.S. Appl. No. 13/907,470, Bowers et al.
(Continued)

*Primary Examiner* — Fenn Mathew
*Assistant Examiner* — Andrew T Kirsch
(74) *Attorney, Agent, or Firm* — Dorsey & Whitney LLP

(57) ABSTRACT

Substantially thermally sealed containers including flexible connectors joining an aperture in the exterior of the container to an aperture in a substantially thermally sealed storage region within the container are described. The flexible connectors include a duct forming an elongated thermal pathway between the exterior of the container and the substantially thermally sealed storage region within the container. The flexible connectors include compression units mated to each end of the duct and a plurality of compression strands connected between the compression units.

54 Claims, 10 Drawing Sheets

Related U.S. Application Data application No. 12/006,089, filed on Dec. 27, 2007, and a continuation-in-part of application No. 12/008,695, filed on Jan. 10, 2008, now Pat. No. 8,377,030, and a continuation-in-part of application No. 12/012,490, filed on Jan. 31, 2008, now Pat. No. 8,069,680, and a continuation-in-part of application No. 12/077,322, filed on Mar. 17, 2008, now Pat. No. 8,215,835, and a continuation-in-part of application No. 12/152,465, filed on May 13, 2008, now Pat. No. 8,485,387, and a continuation-in-part of application No. 12/152,467, filed on May 13, 2008, now Pat. No. 8,211,516, and a continuation-in-part of application No. 12/220,439, filed on Jul. 23, 2008, now Pat. No. 8,603,598, and a continuation-in-part of application No. 12/658,579, filed on Feb. 8, 2010, and a continuation-in-part of application No. 12/927,982, filed on Nov. 29, 2010.

(51) Int. Cl.

| | |
|---|---|
| ***B65D 25/04*** | (2006.01) |
| ***B65D 57/00*** | (2006.01) |
| ***B65D 85/00*** | (2006.01) |
| ***F17C 1/00*** | (2006.01) |
| ***F17C 3/00*** | (2006.01) |
| ***F17C 13/00*** | (2006.01) |
| ***F25D 23/00*** | (2006.01) |
| ***A47J 39/00*** | (2006.01) |
| ***A47J 41/00*** | (2006.01) |
| ***B65D 81/38*** | (2006.01) |
| ***A61J 1/00*** | (2006.01) |
| *F28D 20/02* | (2006.01) |

(56) References Cited

U.S. PATENT DOCUMENTS

| | | | | |
|---|---|---|---|---|
| 2,161,295 | A | | 6/1939 | Hirschberg |
| 2,496,296 | A | | 2/1950 | Lobl |
| 2,717,937 | A | | 9/1955 | Lehr et al. |
| 2,967,152 | A | | 1/1961 | Matsch et al. |
| 3,029,967 | A | | 4/1962 | Morrison |
| 3,034,845 | A | | 5/1962 | Haumann |
| 3,069,045 | A | | 12/1962 | Haumann et al. |
| 3,108,840 | A | | 10/1963 | Conrad et al. |
| 3,238,002 | A | | 3/1966 | O'Connell et al. |
| 3,921,844 | A | | 11/1975 | Walles |
| 3,948,411 | A | * | 4/1976 | Conte ..... 220/560.13 |
| 4,003,426 | A | | 1/1977 | Best et al. |
| 4,034,129 | A | | 7/1977 | Kittle |
| 4,057,029 | A | | 11/1977 | Seiter |
| 4,057,101 | A | | 11/1977 | Ruka et al. |
| 4,094,127 | A | | 6/1978 | Romagnoli |
| 4,154,363 | A | | 5/1979 | Barthel |
| 4,184,601 | A | | 1/1980 | Stewart et al. |
| 4,312,669 | A | | 1/1982 | Boffito et al. |
| 4,318,058 | A | | 3/1982 | Mito et al. |
| 4,358,490 | A | | 11/1982 | Nagai |
| 4,388,051 | A | | 6/1983 | Dresler et al. |
| 4,402,927 | A | | 9/1983 | Von Dardel et al. |
| 4,428,854 | A | | 1/1984 | Enjo et al. |
| 4,481,779 | A | * | 11/1984 | Barthel ..... 62/46.3 |
| 4,481,792 | A | | 11/1984 | Groeger et al. |
| 4,482,465 | A | | 11/1984 | Gray |
| 4,521,800 | A | | 6/1985 | Howe |
| 4,526,015 | A | | 7/1985 | Laskaris |
| 4,640,574 | A | | 2/1987 | Unger |
| 4,726,974 | A | | 2/1988 | Nowobilski et al. |
| 4,766,471 | A | | 8/1988 | Ovshinsky et al. |
| 4,796,432 | A | | 1/1989 | Fixsen et al. |
| 4,810,403 | A | | 3/1989 | Bivens et al. |
| 4,855,950 | A | | 8/1989 | Takada |
| 4,862,674 | A | * | 9/1989 | Lejondahl et al. ..... 53/432 |
| 4,920,387 | A | | 4/1990 | Takasu et al. |
| 4,951,014 | A | | 8/1990 | Wohlert et al. |
| 4,955,204 | A | | 9/1990 | Pehl et al. |
| 4,956,976 | A | | 9/1990 | Kral et al. |
| 4,969,336 | A | | 11/1990 | Knippscheer et al. |
| 4,974,423 | A | | 12/1990 | Pring |
| 4,976,308 | A | | 12/1990 | Faghri |
| 5,012,102 | A | | 4/1991 | Gowlett |
| 5,103,337 | A | | 4/1992 | Schrenk et al. |
| 5,116,105 | A | | 5/1992 | Hong |
| 5,138,559 | A | | 8/1992 | Kuehl et al. |
| 5,187,116 | A | | 2/1993 | Kitagawa et al. |
| 5,215,214 | A | | 6/1993 | Lev et al. |
| 5,245,869 | A | | 9/1993 | Clarke et al. |
| 5,261,241 | A | | 11/1993 | Kitahara et al. |
| 5,277,031 | A | | 1/1994 | Miller et al. |
| 5,277,959 | A | | 1/1994 | Kourtides et al. |
| 5,302,840 | A | | 4/1994 | Takikawa |
| 5,330,816 | A | | 7/1994 | Rusek, Jr. |
| 5,355,684 | A | | 10/1994 | Guice |
| 5,376,184 | A | | 12/1994 | Aspden |
| 5,390,734 | A | | 2/1995 | Voorhes et al. |
| 5,390,791 | A | | 2/1995 | Yeager |
| 5,444,223 | A | | 8/1995 | Blama |
| 5,452,565 | A | | 9/1995 | Blom et al. |
| 5,505,046 | A | | 4/1996 | Nelson et al. |
| 5,548,116 | A | | 8/1996 | Pandelisev |
| 5,563,182 | A | | 10/1996 | Epstein et al. |
| 5,573,133 | A | | 11/1996 | Park |
| 5,580,522 | A | | 12/1996 | Leonard et al. |
| 5,590,054 | A | | 12/1996 | McIntosh |
| 5,600,071 | A | | 2/1997 | Sooriakumar et al. |
| 5,607,076 | A | | 3/1997 | Anthony |
| 5,633,077 | A | | 5/1997 | Olinger |
| 5,671,856 | A | | 9/1997 | Lisch |
| 5,679,412 | A | | 10/1997 | Kuehnle et al. |
| 5,709,472 | A | | 1/1998 | Prusik et al. |
| 5,782,344 | A | | 7/1998 | Edwards et al. |
| 5,800,905 | A | | 9/1998 | Sheridan et al. |
| 5,821,762 | A | | 10/1998 | Hamaguchi et al. |
| 5,829,594 | A | | 11/1998 | Warder |
| 5,846,224 | A | | 12/1998 | Sword et al. |
| 5,846,883 | A | | 12/1998 | Moslehi |
| 5,857,778 | A | | 1/1999 | Ells |
| 5,900,554 | A | | 5/1999 | Baba et al. |
| 5,915,283 | A | | 6/1999 | Reed et al. |
| 5,954,101 | A | | 9/1999 | Drube et al. |
| 6,030,580 | A | | 2/2000 | Raasch et al. |
| 6,042,264 | A | | 3/2000 | Prusik et al. |
| 6,050,598 | A | | 4/2000 | Upton |
| 6,209,343 | B1 | | 4/2001 | Owen |
| 6,212,904 | B1 | | 4/2001 | Arkharov et al. |
| 6,213,339 | B1 | | 4/2001 | Lee |
| 6,234,341 | B1 | | 5/2001 | Tattam |
| 6,272,679 | B1 | | 8/2001 | Norin |
| 6,287,652 | B2 | | 9/2001 | Speckhals et al. |
| 6,321,977 | B1 | | 11/2001 | Lee |
| 6,337,052 | B1 | | 1/2002 | Rosenwasser |
| 6,438,992 | B1 | | 8/2002 | Smith et al. |
| 6,439,406 | B1 | | 8/2002 | Duhon |
| 6,453,749 | B1 | | 9/2002 | Petrovic et al. |
| 6,465,366 | B1 | | 10/2002 | Nemani et al. |
| 6,467,642 | B2 | | 10/2002 | Mullens et al. |
| 6,485,805 | B1 | | 11/2002 | Smith et al. |
| 6,521,077 | B1 | | 2/2003 | McGivern et al. |
| 6,571,971 | B1 | | 6/2003 | Weiler |
| 6,584,797 | B1 | | 7/2003 | Smith et al. |
| 6,624,349 | B1 | | 9/2003 | Bass |
| 6,673,594 | B1 | | 1/2004 | Owen et al. |
| 6,688,132 | B2 | | 2/2004 | Smith et al. |
| 6,692,695 | B1 | | 2/2004 | Bronshtein et al. |
| 6,701,724 | B2 | | 3/2004 | Smith et al. |
| 6,742,650 | B2 | | 6/2004 | Yang et al. |
| 6,742,673 | B2 | | 6/2004 | Credle, Jr. et al. |
| 6,751,963 | B2 | | 6/2004 | Navedo et al. |
| 6,771,183 | B2 | | 8/2004 | Hunter |
| 6,806,808 | B1 | | 10/2004 | Watters et al. |
| 6,813,330 | B1 | | 11/2004 | Barker et al. |
| 6,841,917 | B2 | | 1/2005 | Potter |

(56) References Cited

U.S. PATENT DOCUMENTS

| | | | |
|---|---|---|---|
| 6,877,504 | B2 | 4/2005 | Schreff et al. |
| 6,967,051 | B1 | 11/2005 | Augustynowicz et al. |
| 6,997,241 | B2 | 2/2006 | Chou et al. |
| 7,001,656 | B2 | 2/2006 | Maignan et al. |
| 7,038,585 | B2 | 5/2006 | Hall et al. |
| 7,128,807 | B2 | 10/2006 | Mörschner et al. |
| 7,240,513 | B1 | 7/2007 | Conforti |
| 7,253,788 | B2 | 8/2007 | Choi et al. |
| 7,258,247 | B2 | 8/2007 | Marquez |
| 7,267,795 | B2 | 9/2007 | Ammann et al. |
| 7,278,278 | B2 | 10/2007 | Wowk et al. |
| 7,596,957 | B2 | 10/2009 | Fuhr et al. |
| 7,789,258 | B1 | 9/2010 | Anderson |
| 7,807,242 | B2 | 10/2010 | Soerensen et al. |
| 7,982,673 | B2 | 7/2011 | Orton et al. |
| 8,074,271 | B2 | 12/2011 | Davis et al. |
| 8,138,913 | B2 | 3/2012 | Nagel et al. |
| 8,174,369 | B2 | 5/2012 | Jones et al. |
| 8,211,516 | B2 | 7/2012 | Bowers et al. |
| 2002/0050514 | A1 | 5/2002 | Schein |
| 2002/0083717 | A1 | 7/2002 | Mullens et al. |
| 2002/0084235 | A1 | 7/2002 | Lake |
| 2002/0130131 | A1 | 9/2002 | Zucker et al. |
| 2002/0155699 | A1 | 10/2002 | Ueda |
| 2002/0187618 | A1 | 12/2002 | Potter |
| 2003/0039446 | A1 | 2/2003 | Hutchinson et al. |
| 2003/0072687 | A1 | 4/2003 | Nehring et al. |
| 2003/0148773 | A1 | 8/2003 | Spriestersbach et al. |
| 2003/0160059 | A1 | 8/2003 | Credle, Jr. et al. |
| 2004/0035120 | A1 | 2/2004 | Brunnhofer |
| 2004/0055313 | A1 | 3/2004 | Navedo et al. |
| 2004/0055600 | A1 | 3/2004 | Izuchukwu |
| 2004/0103302 | A1 | 5/2004 | Yoshimura et al. |
| 2004/0145533 | A1 | 7/2004 | Taubman |
| 2005/0009192 | A1 | 1/2005 | Page |
| 2005/0029149 | A1 | 2/2005 | Leung et al. |
| 2005/0053345 | A1 | 3/2005 | Bayindir et al. |
| 2005/0067441 | A1 | 3/2005 | Alley |
| 2005/0143787 | A1 | 6/2005 | Boveja et al. |
| 2005/0188715 | A1 | 9/2005 | Aragon |
| 2005/0247312 | A1 | 11/2005 | Davies |
| 2005/0255261 | A1 | 11/2005 | Nomula |
| 2005/0274378 | A1 | 12/2005 | Bonney et al. |
| 2006/0021355 | A1 | 2/2006 | Boesel et al. |
| 2006/0027467 | A1 | 2/2006 | Ferguson |
| 2006/0054305 | A1 | 3/2006 | Ye |
| 2006/0071585 | A1 | 4/2006 | Wang |
| 2006/0150662 | A1 | 7/2006 | Lee et al. |
| 2006/0187026 | A1 | 8/2006 | Kochis |
| 2006/0191282 | A1 | 8/2006 | Sekiya et al. |
| 2006/0196876 | A1 | 9/2006 | Rohwer |
| 2006/0259188 | A1 | 11/2006 | Berg |
| 2006/0280007 | A1 | 12/2006 | Ito et al. |
| 2007/0041814 | A1 | 2/2007 | Lowe |
| 2007/0210090 | A1 | 9/2007 | Sixt et al. |
| 2008/0012577 | A1 | 1/2008 | Potyrailo et al. |
| 2008/0022698 | A1* | 1/2008 | Hobbs et al. ..... 62/51.1 |
| 2008/0060215 | A1 | 3/2008 | Reilly et al. |
| 2008/0129511 | A1 | 6/2008 | Yuen et al. |
| 2008/0164265 | A1 | 7/2008 | Conforti |
| 2008/0184719 | A1 | 8/2008 | Lowenstein |
| 2008/0186139 | A1 | 8/2008 | Butler et al. |
| 2008/0233391 | A1 | 9/2008 | Sterzel et al. |
| 2008/0269676 | A1 | 10/2008 | Bieberich et al. |
| 2008/0272131 | A1 | 11/2008 | Roberts et al. |
| 2008/0297346 | A1 | 12/2008 | Brackmann et al. |
| 2009/0049845 | A1 | 2/2009 | McStravick et al. |
| 2009/0275478 | A1 | 11/2009 | Atkins et al. |
| 2009/0301125 | A1 | 12/2009 | Myles et al. |
| 2009/0309733 | A1 | 12/2009 | Moran et al. |
| 2010/0016168 | A1 | 1/2010 | Atkins et al. |
| 2010/0028214 | A1 | 2/2010 | Howard et al. |
| 2010/0265068 | A1 | 10/2010 | Brackmann et al. |
| 2010/0287963 | A1 | 11/2010 | Billen et al. |
| 2011/0100605 | A1 | 5/2011 | Zheng et al. |
| 2011/0117538 | A1 | 5/2011 | Niazi |
| 2011/0297306 | A1 | 12/2011 | Yang |
| 2012/0168645 | A1 | 7/2012 | Atzmony et al. |
| 2013/0306656 | A1 | 11/2013 | Eckhoff et al. |

FOREIGN PATENT DOCUMENTS

| | | | |
|---|---|---|---|
| CN | 1496537 | A | 5/2004 |
| CN | 1756912 | A | 4/2006 |
| CN | 1827486 | A | 9/2006 |
| CN | 101073524 | A | 11/2007 |
| FR | 2 621 685 | | 10/1987 |
| GB | 2 441 636 | A | 3/2008 |
| WO | WO 94/15034 | | 7/1994 |
| WO | WO 99/36725 | A1 | 7/1999 |
| WO | WO 2005/084353 | A2 | 9/2005 |
| WO | WO 2007/039553 | A2 | 4/2007 |

OTHER PUBLICATIONS

U.S. Appl. No. 13/906,909, Bloedow et al.

Abdul-Wahab et al.; "Design and experimental investigation of portable solar thermoelectric refrigerator"; Renewable Energy; 2009; pp. 30-34; vol. 34; Elsevier Ltd.

Astrain et al.; "Computational model for refrigerators based on Peltier effect application"; Applied Thermal Engineering; 2005; pp. 3149-3162; vol. 25; Elsevier Ltd.

Azzouz et al.; "Improving the energy efficiency of a vapor compression system using a phase change material"; Second Conference on Phase Change Material & Slurry: Scientific Conference & Business Forum; Jun. 15-17, 2005; pp. 1-11; Yverdon-les-Bains, Switzerland.

Chatterjee et al.; "Thermoelectric cold-chain chests for storing/transporting vaccines in remote regions"; Applied Energy; 2003; pp. 415-433; vol. 76; Elsevier Ltd.

Chiu et al.; "Submerged finned heat exchanger latent heat storage design and its experimental verification"; Applied Energy; 2012; pp. 507-516; vol. 93; Elsevier Ltd.

Conway et al.; "Improving Cold Chain Technologies through the Use of Phase Change Material"; Thesis, University of Maryland; 2012; pp. ii-xv and 16-228.

Dai et al.; "Experimental investigation and analysis on a thermoelectric refrigerator driven by solar cells"; Solar Energy Materials & Solar Cells; 2003; pp. 377-391; vol. 77; Elsevier Science B.V.

Ghoshal et al.; "Efficient Switched Thermoelectric Refrigerators for Cold Storage Applications"; Journal of Electronic Materials; 2009; pp. 1-6; doi: 10.1007/s11664-009-0725-3.

Groulx et al.; "Solid-Liquid Phase Change Simulation Applied to a Cylindrical Latent Heat Energy Storage System"; Excerpt from the Proceedings of the COMSOL Conference, Boston; 2009; pp. 1-7.

Jiajitsawat, Somchai; "A Portable Direct-PV Thermoelectric Vaccine Refrigerator with Ice Storage Through Heat Pipes"; Dissertation, University of Massachusetts, Lowell; 2008; three cover pages, pp. ii-x, 1-137.

Kempers et al.; "Characterization of evaporator and condenser thermal resistances of a screen mesh wicked heat pipe"; International Journal of Heat and Mass Transfer; 2008; pp. 6039-6046; vol. 51; Elsevier Ltd.

Mohamad et al.; "An Analysis of Sensitivity Distribution Using Two Differential Excitation Potentials in ECT"; IEEE Fifth International Conference on Sensing Technology; 2011; pp. 575-580; IEEE.

Mohamad et al.; "A introduction of two differential excitation potentials technique in electrical capacitance tomography"; Sensors and Actuators A; 2012; pp. 1-10; vol. 180; Elsevier B.V.

Mughal et al.; "Review of Capacitive Atmospheric Icing Sensors"; The Sixth International Conference on Sensor Technologies and Applications (SENSORCOMM); 2012; pp. 42-47; IARIA.

Omer et al.; "Design optimization of thermoelectric devices for solar power generation"; Solar Energy Materials and Solar Cells; 1998; pp. 67-82; vol. 53; Elsevier Science B.V.

Omer et al.; "Experimental investigation of a thermoelectric refrigeration system employing a phase change material integrated with thermal diode (thermosyphons)"; Applied Thermal Engineering; 2001; pp. 1265-1271; vol. 21; Elsevier Science Ltd.

(56) References Cited

OTHER PUBLICATIONS

Oró et al.; "Review on phase change materials (PCMs) for cold thermal energy storage applications"; Applied Energy; 2012; pp. 1-21; doi: 10.1016/j.apenergy.2012.03.058; Elsevier Ltd.
Owusu, Kwadwo Poku; "Capacitive Probe for Ice Detection and Accretion Rate Measurement: Proof of Concept"; Master of Science Thesis, Department of Mechanical Engineering, University of Manitoba; 2010; pp. i-xi, 1-95.
Peng et al.; "Determination of the optimal axial length of the electrode in an electrical capacitance tomography sensor"; Flow Measurement and Instrumentation; 2005; pp. 169-175; vol. 16; Elsevier Ltd.
Peng et al.; "Evaluation of Effect of Number of Electrodes in ECT Sensors on Image Quality"; IEEE Sensors Journal; May 2012; pp. 1554-1565; vol. 12, No. 5; IEEE.
Riffat et al.; "A novel thermoelectric refrigeration system employing heat pipes and a phase change material: an experimental investigation"; Renewable Energy; 2001; pp. 313-323; vol. 23; Elsevier Science Ltd.
Robak et al.; "Enhancement of latent heat energy storage using embedded heat pipes"; International Journal of Heat and Mass Transfer; 2011; pp. 3476-3483; vol. 54; Elsevier Ltd.
Rodríguez et al.; "Development and experimental validation of a computational model in order to simulate ice cube production in a thermoelectric ice maker"; Applied Thermal Engineering; 2009; one cover page and pp. 1-28; doi: 10.1016/j.applthermaleng.2009.03.005.
Russel et al.; "Characterization of a thermoelectric cooler based thermal management system under different operating conditions"; Applied Thermal Engineering; 2012; two cover pages and pp. 1-29; doi: 10.1016/j.applthermaleng.2012.05.002.
Sharifi et al.; "Heat pipe-assisted melting of a phase change material"; International Journal of Heat and Mass Transfer; 2012; pp. 3458-3469; vol. 55; Elsevier Ltd.
Stampa et al.; "Numerical Study of Ice Layer Growth Around a Vertical Tube"; Engenharia Térmica (Thermal Engineering); Oct. 2005; pp. 138-144; vol. 4, No. 2.
Vián et al.; "Development of a thermoelectric refrigerator with two-phase thermosyphons and capillary lift"; Applied Thermal Engineering; 2008; one cover page and pp. 1-16 doi: 10.1016/j.applthermaleng.2008.09.018.
Ye et al.; "Evaluation of Electrical Capacitance Tomography Sensors for Concentric Annulus"; IEEE Sensors Journal; Feb. 2013; pp. 446-456; vol. 13, No. 2; IEEE.
Yu et al.; "Comparison Study of Three Common Technologies for Freezing-Thawing Measurement"; Advances in Civil Engineering; 2010; pp. 1-10; doi: 10.1155/2010/239651.
U.S. Appl. No. 12/220,439, Hyde et al.
U.S. Appl. No. 12/152,467, Bowers et al.
U.S. Appl. No. 12/152,465, Bowers et al.
U.S. Appl. No. 12/077,322, Hyde et al.
U.S. Appl. No. 12/012,490, Hyde et al.
U.S. Appl. No. 12/008,695, Hyde et al.
U.S. Appl. No. 12/006,089, Hyde et al.
U.S. Appl. No. 12/006,088, Hyde et al.
U.S. Appl. No. 12/001,757, Hyde et al.
3M Monitor Mark™; "Time Temperature Indicators—Providing a visual history of time temperature exposure"; 3M Microbiology; bearing a date of 2006; pp. 1-4; located at 3M.com/microbiology.
Chen, Dexiang, et al.; "Opportunities and challenges of developing thermostable vaccines"; Expert Reviews Vaccines; 2009; pp. 547-557; vol. 8, No. 5; Expert Reviews Ltd.
Chiritescu, Catalin; Cahill, David G.; Nguyen, Ngoc; Johnson, David; Bodapati, Arun; Keblinski, Pawel; Zschack, Paul; "Ultralow Thermal Conductivity in Disordered, Layered WSe2 Crystals; Science"; Jan. 19, 2007; pp. 351-353; vol. 315; The American Association for the Advancement of Science.
Cole-Parmer; "Temperature Labels and Crayons."; www.coleparmer.com; bearing a date of 1971 and printed on Sep. 27, 2007; p. 1.
Daryabeigi, Kamran; "Thermal Analysis and Design Optimization of Multilayer Insulation for Reentry Aerodynamic Heating"; Journal of Spacecraft and Rockets; Jul.-Aug. 2002; pp. 509-514; vol. 39; No. 4; American Institute of Aeronautics and Astronautics Inc.
Fricke, Jochen; Emmerling, Andreas; "Aerogels—Preparation, Properties, Applications"; Structure and Bonding; 1992; pp. 37-87; vol. 77; Springer-Verlag Berlin Heidelberg.
Hedayat, A., et al.; "Variable Density Multilayer Insulation for Cryogenic Storage"; Bearing a date of 2000; pp. 1-10.
Keller, C. W., et al.; "Thermal Performance of Multilayer Insulations, Final Report, Contract NAS 3-14377"; Bearing a date of Apr. 5, 1974; pp. 1-446.
Matthias, Dipika M., et al.; "Freezing temperatures in the vaccine cold chain: A systematic literature review"; Vaccine; 2007; pp. 3980-3986; vol. 25; Elsevier Ltd.
Shockwatch; "Environmental Indicators"; printed on Sep. 27, 2007; pp. 1-2; located at www.shockwatch.com.
Spur Industries Inc.; "The Only Way to Get Them Apart is to Melt Them Apart"; 2006; pp. 1-3; located at http://www.spurind.com/applications.php.
Wirkas, Theo, et al.; "A vaccine cold chain freezing study in PNG highlights technology needs for hot climate countries"; Vaccine; 2007; pp. 691-697; vol. 25; Elsevier Ltd.
World Health Organization; "Getting started with vaccine vial monitors; Vaccines and Biologicals"; World Health Organization; Dec. 2002; pp. 1-20 plus cover sheets, end sheet, contents pages, abbreviations page; revision history page and acknowledgments page (29 pages total); World Health Organization; located at www.who.int/vaccines-documents.
World Health Organization; "Getting started with vaccine vial monitors—Questions and answers on field operations"; Technical Session on Vaccine Vial Monitors, Mar. 27, 2002, Geneva; pp. 1-17 (p. 2 left intentionally blank); World Health Organization.
World Health Organization; "Preventing Freeze Damage to Vaccines: Aide-memoire for prevention of freeze damage to vaccines"; 2007; pp. 1-4; WHO/IVB/07.09; World Health Organization.
World Health Organization; "Temperature sensitivity of vaccines"; Department of Immunization, Vaccines and Biologicals, World Health Organization; Aug. 2006; pp. 1-62 plus cover sheet, pp. i-ix, and end sheet (73 pages total); WHO/IVB/06.10; World Health Organization.
PCT International Search Report; International App. No. PCT/US 11/00234; Jun. 9, 2011; pp. 1-4.
U.S. Appl. No. 13/489,058, Bowers et al.
Chinese State Intellectual Property Office; Office Action; Chinese Application No. 200980109399.4; dated Aug. 29, 2012; pp. 1-12 (No translation provided).
Chinese State Intellectual Property Office, Office Action; App. No. 200880119918.0; Sep. 18, 2013 (rec'd by our agent Sep. 20, 2013); pp. 1-10 (no English translation available).
Bapat, S. L. et al.; "Experimental investigations of multilayer insulation"; *Cryogenics;* Bearing a date of Aug. 1990; pp. 711-719; vol. 30.
Bapat, S. L. et al.; "Performance prediction of multilayer insulation"; *Cryogenics;* Bearing a date of Aug. 1990; pp. 700-710; vol. 30.
Barth, W. et al.; "Experimental investigations of superinsulation models equipped with carbon paper"; *Cryogenics;* Bearing a date of May 1988; pp. 317-320; vol. 28.
Barth, W. et al.; "Test results for a high quality industrial superinsulation"; *Cryogenics;* Bearing a date of Sep. 1988; pp. 607-609; vol. 28.
Benvenuti, C. et al.; "Obtention of pressures in the $10^{-14}$ torr range by means of a Zr V Fe non evaporable getter"; *Vacuum;* Bearing a date of 1993; pp. 511-513; vol. 44; No. 5-7; Pergamon Press Ltd.
Benvenuti, C.; "Decreasing surface outgassing by thin film getter coatings"; *Vacuum;* Bearing a date of 1998; pp. 57-63; vol. 50; No. 1-2; Elsevier Science Ltd.
Benvenuti, C.; "Nonevaporable getter films for ultrahigh vacuum applications"; *Journal of Vacuum Science Technology a Vacuum Surfaces, and Films;* Bearing a date of Jan./Feb. 1998; pp. 148-154; vol. 16; No. 1; American Chemical Society.
Berman, A.; "Water vapor in vacuum systems"; *Vacuum;* Bearing a date of 1996; pp. 327-332; vol. 47; No. 4; Elsevier Science Ltd.

(56) References Cited

OTHER PUBLICATIONS

Bernardini, M. et al.; "Air bake-out to reduce hydrogen outgassing from stainless steel"; *Journal of Vacuum Science Technology;* Bearing a date of Jan./Feb. 1998; pp. 188-193; vol. 16; No. 1; American Chemical Society.
Bo, H. et al.; "Tetradecane and hexadecane binary mixtures as phase change materials (PCMs) for cool storage in district cooling systems"; *Energy;* Bearing a date of 1999; vol. 24; pp. 1015-1028; Elsevier Science Ltd.
Boffito, C. et al.; "A nonevaporable low temperature activatable getter material"; *Journal of Vacuum Science Technology;* Bearing a date of Apr. 1981; pp. 1117-1120; vol. 18; No. 3; American Vacuum Society.
Brown, R.D.; "Outgassing of epoxy resins in vacumm."; *Vacuum;* Bearing a date of 1967; pp. 25-28; vol. 17; No. 9; Pergamon Press Ltd.
Burns, H. D.; "Outgassing Test for Non-metallic Materials Associated with Sensitive Optical Surfaces in a Space Environment"; MSFC-SPEC-1443; Bearing a date of Oct. 1987; pp. 1-10.
Chen, G. et al.; "Performance of multilayer insulation with slotted shield"; *Cryogenics ICEC Supplement;* Bearing a date of 1994; pp. 381-384; vol. 34.
Chen, J. R. et al.; "An aluminum vacuum chamber for the bending magnet of the SRRC synchrotron light source"; *Vacuum;* Bearing a date of 1990; pp. 2079-2081; vol. 41; No. 7-9; Pergamon Press PLC.
Chen, J. R. et al.; "Outgassing behavior of A6063-EX aluminum alloy and SUS 304 stainless steel"; *Journal of Vacuum Science Technology;* Bearing a date of Nov./Dec. 1987; pp. 3422-3424; vol. 5; No. 6; American Vacuum Society.
Chen, J. R. et al.; "Outgassing behavior on aluminum surfaces: Water in vacuum systems"; *Journal of Vacuum Science Technology;* Bearing a date of Jul./Aug. 1994; pp. 1750-1754; vol. 12; No. 4; American Vacuum Society.
Chen, J. R. et al.; "Thermal outgassing from aluminum alloy vacuum chambers"; *Journal of Vacuum Science Technology;* Bearing a date of Nov./Dec. 1985; pp. 2188-2191; vol. 3; No. 6; American Vacuum Society.
Chen, J. R.; "A comparison of outgassing rate of 304 stainless steel and A6063-EX aluminum alloy vacuum chamber after filling with water"; *Journal of Vacuum Science Technology A Vacuum Surfaces and Film;* Bearing a date of Mar. 1987; pp. 262-264; vol. 5; No. 2; American Chemical Society.
Chiggiato, P.; "Production of extreme high vacuum with non evaporable getters" *Physica Scripta;* Bearing a date of 1997; pp. 9-13; vol. T71.
Cho, B.; "Creation of extreme high vacuum with a turbomolecular pumping system: A baking approach"; *Journal of Vacuum Science Technology;* Bearing a date of Jul./Aug. 1995; pp. 2228-2232; vol. 13; No. 4; American Vacuum Society.
Choi, S. et al.; "Gas permeability of various graphite/epoxy composite laminates for cryogenic storage systems"; *Composites Part B: Engineering;* Bearing a date of 2008; pp. 782-791; vol. 39; Elsevier Science Ltd.
Chun, I. et al.; "Effect of the Cr-rich oxide surface on fast pumpdown to ultrahigh vacuum"; *Journal of Vacuum Science Technology A Vacuum, Surfaces, and Films;* Bearing a date of Sep./Oct. 1997; pp. 2518-2520; vol. 15; No. 5; American Vacuum Society.
Chun, I. et al.; "Outgassing rate characteristic of a stainless-steel extreme high vacuum system"; *Journal of Vacuum Science Technology;* Bearing a date of Jul./Aug. 1996; pp. 2636-2640; vol. 14; No. 4; American Vacuum Society.
Crawley, D J. et al.; "Degassing Characteristics of Some 'O' Ring Materials"; *Vacuum;* Bearing a date of 1963; pp. 7-9; vol. 14; Pergamon Press Ltd.
Csernatony, L.; "The Properties of Viton 'A' Elastomers II. The influence of permeation, diffusion and solubility of gases on the gas emission rate from an O-ring used as an atmospheric seal or high vacuum immersed"; *Vacuum;* Bearing a date of 1965; pp. 129-134; vol. 16; No. 3; Pergamon Press Ltd.
Day, C.; "The use of active carbons as cryosorbent"; *Colloids and Surfaces a Physicochemical and Engineering Aspects;* Bearing a date of 2001; pp. 187-206; vol. 187-188; Elsevier Science.
Della Porta, P.; "Gas problem and gettering in sealed-off vacuum devices"; *Vacuum;* Bearing a date of 1996; pp. 771-777; vol. 47; No. 6-8 Elsevier Science Ltd.
Dylla, H. F. et al.; "Correlation of outgassing of stainless steel and aluminum with various surface treatments"; *Journal of Vacuum Science Technology;* Bearing a date of Sep./Oct. 1993; pp. 2623-2636; vol. 11; No. 5; American Vacuum Society.
Elsey, R. J. "Outgassing of vacuum material I"; *Vacuum;* Bearing a date of 1975; pp. 299-306; vol. 25; No. 7; Pergamon Press Ltd.
Elsey, R. J. "Outgassing of vacuum materials II" *Vacuum;* Bearing a date of 1975; pp. 347-361; vol. 25; No. 8; Pergamon Press Ltd.
Engelmann, G. et al.; "Vacuum chambers in composite material"; *Journal of Vacuum Science Technology;* Bearing a date of Jul./Aug. 1987; pp. 2337-2341; vol. 5; No. 4; American Vacuum Society.
Eyssa, Y. M. et al.; "Thermodynamic optimization of thermal radiation shields for a cryogenic apparatus"; *Cryogenics;* Bearing a date of May 1978; pp. 305-307; vol. 18; IPC Business Press.
Glassford, A. P. M. et al.; "Outgassing rate of multilayer insulation"; 1978; Bearing a date of 1978; pp. 83-106.
Gupta, A. K. et al.; "Outgassing from epoxy resins and methods for its reduction"; *Vacuum;* Bearing a date of 1977; pp. 61-63; vol. 27; No. 12; Pergamon Press Ltd.
HaŁaczek, T. et al.; "Flat-plate cryostat for measurements of multilayer insulation thermal conductivity"; *Cryogenics;* Bearing a date of Oct. 1985; pp. 593-595; vol. 25; Butterworth & Co. Ltd.
HaŁaczek, T. et al.; "Unguarded cryostat for thermal conductivity measurements of multilayer insulations"; *Cryogenics;* Bearing a date of Sep. 1985; pp. 529-530; vol. 25; Butterworth & Co. Ltd.
HaŁaczek, T. L. et al.; "Heat transport in self-pumping multilayer insulation"; *Cryogenics;* Bearing a date of Jun. 1986; pp. 373-376; vol. 26; Butterworth & Co. Ltd.
HaŁaczek, T. L. et al.; "Temperature variation of thermal conductivity of self-pumping multilayer insulation"; *Cryogenics;* Bearing a date of Oct. 1986; pp. 544-546.; vol. 26; Butterworth & Co. Ltd.
Halldórsson, Árni, et al.; "The sustainable agenda and energy efficiency: Logistics solutions and supply chains in times of climate change"; *International Journal of Physical Distribution & Logistics Management;* Bearing a date of 2010; pp. 5-13; vol. 40; No. ½; Emerald Group Publishing Ltd.
Halliday, B. S.; "An introduction to materials for use in vacuum"; *Vacuum;* Bearing a date of 1987; pp. 583-585; vol. 37; No. 8-9; Pergamon Journals Ltd.
Hirohata, Y.; "Hydrogen desorption behavior of aluminium materials used for extremely high vacuum chamber"; *Journal of Vacuum Science Technology;* Bearing a date of Sep./Oct. 1993; pp. 2637-2641; vol. 11; No. 5; American Vacuum Society.
Holtrop, K. L. et al.; "High temperature outgassing tests on materials used in the DIII-D tokamak"; *Journal of Vacuum Science Technology;* Bearing a date of Jul./Aug. 2006; pp. 1572-; vol. 24; No. 4; American Vacuum Society.
Hong, S. et al.; "Investigation of gas species in a stainless steel ultrahigh vacuum chamber with hot cathode ionization gauges"; *Measurement Science and Technology;* Bearing a date of 2004; pp. 359-364; vol. 15; IOP Science.
Ishikawa, Y. et al.; "Reduction of outgassing from stainless surfaces by surface oxidation"; *Vacuum;* Bearing a date of 1990; pp. 1995-1997; vol. 4; No. 7-9; Pergamon Press PLC.
Ishikawa, Y.; "An overview of methods to suppress hydrogen outgassing rate from austenitic stainless steel with reference to UHV and EXV"; *Vacuum;* Bearing a date of 2003; pp. 501-512; vol. 69; No. 4; Elsevier Science Ltd.
Ishimaru, H. et al.; "All Aluminum Alloy Vacuum System for the TRISTAN e+ e-Storage"; *IEEE Transactions on Nuclear Science;* Bearing a date of Jun. 1981; pp. 3320-3322; vol. NS-28; No. 3.
Ishimaru, H. et al.; "Fast pump-down aluminum ultrahigh vacuum system"; *Journal of Vacuum Science Technology;* Bearing a date of May/Jun. 1992; pp. 547-552 ; vol. 10; No. 3; American Vacuum Society.

(56) References Cited

OTHER PUBLICATIONS

Ishimaru, H. et al.; "Turbomolecular pump with an ultimate pressure of $10^{-12}$ Torr"; *Journal of Vacuum Science Technology;* Bearing a date of Jul./Aug. 1994; pp. 1695-1698; vol. 12; No. 4; American Vacuum Society.
Ishimaru, H.; "All-aluminum-alloy ultrahigh vacuum system for a large-scale electron-positron collider"; *Journal of Vacuum Science Technology;* Bearing a date of Jun. 1984; pp. 1170-1175; vol. 2; No. 2; American Vacuum Society.
Ishimaru, H.; "Aluminium alloy-sapphire sealed window for ultrahigh vacuum"; *Vacuum;* Bearing a date of 1983; pp. 339-340.; vol. 33; No. 6; Pergamon Press Ltd.
Ishimaru, H.; "Bakeable aluminium vacuum chamber and bellows with an aluminium flange and metal seal for ultra-high vacuum"; *Journal of Vacuum Science Technology;* Bearing a date of Nov./Dec. 1978; pp. 1853-1854; vol. 15; No. 6; American Vacuum Society.
Ishimaru, H.; "Ultimate pressure of the order of $10^{-13}$ Torr in an aluminum alloy vacuum chamber"; *Journal of Vacuum Science and Technology;* Bearing a date of May/Jun. 1989; pp. 2439-2442; vol. 7; No. 3; American Vacuum Society.
Jacob, S. et al.; "Investigations into the thermal performance of multilayer insulation (300-77 K) Part 2: Thermal analysis"; *Cryogenics;* Bearing a date of 1992; pp. 1147-1153; vol. 32; No. 12; Butterworth-Heinemann Ltd.
Jacob, S. et al.; "Investigations into the thermal performance of multilayer insulation (300-77 K) Part 1: Calorimetric studies"; *Cryogenics;* Bearing a date of 1992; pp. 1137-1146; vol. 32; No. 12; Butterworth-Heinemann Ltd.
Jenkins, C. H. M.; "Gossamer spacecraft: membrane and inflatable structures technology for space applications"; AIAA; Bearing a date of 2000; pp. 503-527; vol. 191.
Jhung, K. H. C. et al.; "Achievement of extremely high vacuum using a cryopump and conflat aluminium"; *Vacuum;* Bearing a date of 1992; pp. 309-311; vol. 43; No. 4; Pergamon Press PLC.
Kato, S. et al.; "Achievement of extreme high vacuum in the order of $10^{-10}$ Pa without baking of test chamber"; *Journal of Vacuum Science Technology;* Bearing a date of May/Jun. 1990; pp. 2860-2864; vol. 8 ; No. 3; American Vacuum Society.
Keller, K. et al.; "Application of high temperature multilayer insulations"; *Acta Astronautica;* Bearing a date of 1992; pp. 451-458; vol. 26; No. 6; Pergamon Press Ltd.
Koyatsu, Y. et al. "Measurements of outgassing rate from copper and copper alloy chambers"; *Vacuum*; Bearing a date of 1996; pp. 709-711; vol. 4; No. 6-8; Elsevier Science Ltd.
Kristensen, D. et al.; "Stabilization of vaccines: Lessons learned"; *Human Vaccines;* Bearing a date of Mar. 2010; pp. 227-231; vol. 6; No. 3; Landes Bioscience.
Kropschot, R. H.; "Multiple layer insulation for cryogenic applications"; *Cryogenics;* Bearing a date of Mar. 1961; pp. 135-135; vol. 1.
Li, Y.; "Design and pumping characteristics of a compact titanium—vanadium non-evaporable getter pump"; *Journal of Vacuum Science Technology;* Bearing a date of May/Jun. 1998; pp. 1139-1144; vol. 16; No. 3; American Vacuum Society.
Liu, Y. C. et al.; "Thermal outgassing study on aluminum surfaces"; *Vacuum;* Bearing a date of 1993; pp. 435-437; vol. 44; No. 5-7; Pergamon Press Ltd.
Londer, H. et al.; "New high capacity getter for vacuum insulated mobile LH2 storage tank systems"; *Vacuum;* Bearing a date of 2008; pp. 431-434; vol. 82; No. 4; Elsevier Ltd.
Matsuda, A. et al.; "Simple structure insulating material properties for multilayer insulation"; *Cryogenics;* Bearing a date of Mar. 1980; pp. 135-138; vol. 20; IPC Business Press.
Mikhalchenko, R. S. et al.; "Study of heat transfer in multilayer insulations based on composite spacer materials."; *Cryogenics;* Bearing a date of Jun. 1983; pp. 309-311; vol. 23; Butterworth & Co. Ltd.
Mikhalchenko, R. S. et al.; "Theoretical and experimental investigation of radiative-conductive heat transfer in multilayer insulation"; *Cryogenics;* Bearing a date of May 1985; pp. 275-278; vol. 25; Butterworth & Co. Ltd.
Miki, M. et al.; "Characteristics of extremely fast pump-down process in an aluminum ultrahigh vacuum system"; *Journal of Vacuum Science Technology;* Bearing a date of Jul./Aug. 1994; pp. 1760-1766; vol. 12; No. 4; American Vacuum Society.
Mohri, M. et al.; "Surface study of Type 6063 aluminium alloys for vacuum chamber materials"; *Vacuum;* Bearing a date of 1984; pp. 643-647; vol. 34; No. 6; Pergamon Press Ltd.
Mukugi, K. et al.; "Characteristics of cold cathode gauges for outgassing measurements in uhv range"; *Vacuum;* Bearing a date of 1993; pp. 591-593; vol. 44; No. 5-7; Pergamon Press Ltd.
Nemanič, V. et al.; "Anomalies in kinetics of hydrogen evolution from austenitic stainless steel from 300 to 1000°C"; *Journal of Vacuum Science Technology;* Bearing a date of Jan./Feb. 2001; pp. 215-222; vol. 19; No. 1; American Vacuum Society.
Nemanič, V. et al.; "Outgassing in thin wall stainless steel cells"; *Journal of Vacuum Science Technology;* Bearing a date of May/Jun. 1999; pp. 1040-1046; vol. 17; No. 3; American Vacuum Society.
Nemanič, V.; "Outgassing of thin wall stainless steel chamber"; *Vacuum;* Bearing a date of 1998; pp. 431-437; vol. 50; No. 3-4; Elsevier Science Ltd.
Nemanič, V.; "Vacuum insulating panel"; *Vacuum;* bearing a date of 1995; pp. 839-842; vol. 46; No. 8-10; Elsevier Science Ltd.
Odaka, K. et al.;"Effect of baking temperature and air exposure on the outgassing rate of type 316L stainless steel"; *Journal of Vacuum Science Technology;* Bearing a date of Sep./Oct. 1987; pp. 2902-2906; vol. 5; No. 5; American Vacuum Society.
Odaka, K.; "Dependence of outgassing rate on surface oxide layer thickness in type 304 stainless steel before and after surface oxidation in air"; *Vacuum;* Bearing a date of 1996; pp. 689-692; vol. 47; No. 6-8; Elsevier Science Ltd.
Okamura, S. et al.; "Outgassing measurement of finely polished stainless steel"; *Journal of Vacuum Science Technology;* Bearing a date of Jul./Aug. 1991; pp. 2405-2407; vol. 9; No. 4; American Vacuum Society.
Patrick, T. J.; "Outgassing and the choice of materials for space instrumentation"; *Vacuum;* Bearing a date of 1973; pp. 411-413; vol. 23; No. 11; Pergamon Press Ltd.
Patrick, T. J.; "Space environment and vacuum properties of spacecraft materials"; *Vacuum;* Bearing a date of 1981; pp. 351-357; vol. 31; No. 8-9; Pergamon Press Ltd.
Poole, K. F. et al.; "Hialvac and Teflon outgassing under ultra-high vacuum conditions"; *Vacuum;* Bearing a date of Jun. 30, 1980; pp. 415-417; vol. 30; No. 10; Pergamon Press Ltd.
Redhead, P. A.; "Recommended practices for measuring and reporting outgassing data"; *Journal of Vacuum Science Technology;* Bearing a date of Sep./Oct. 2002; pp. 1667-1675; vol. 20; No. 5; American Vacuum Society.
Rutherford, S; "The Benefits of Viton Outgassing"; Bearing a date of 1997; pp. 1-5; Duniway Stockroom Corp.
Saito, K. et al.; "Measurement system for low outgassing materials by switching between two pumping paths"; *Vacuum;* Bearing a date of 1996; pp. 749-752; vol. 47; No. 6-8; Elsevier Science Ltd.
Saitoh, M. et al.; "Influence of vacuum gauges on outgassing rate measurements"; *Journal of Vacuum Science Technology;* Bearing a date of Sep./Oct. 1993; pp. 2816-2821; vol. 11; No. 5; American Vacuum Society.
Santhanam, S. M. T. J. et al. ;"Outgassing rate of reinforced epoxy and its control by different pretreatment methods"; *Vacuum;* Bearing a date of 1978; pp. 365-366; vol. 28; No. 8-9; Pergamon Press Ltd.
Sasaki, Y. T.; "Reducing SS 304/316 hydrogen outgassing to $2\times10^{-15}$ torr $\sqrt{cm}^{2}s$"; *Journal of Vacuum Science Technology;* Bearing a date of Jul./Aug. 2007; pp. 1309-1311; vol. 25; No. 4; American Vacuum Society.
Scurlock, R. G. et al.; "Development of multilayer insulations with thermal conductivities below 0.1 $\mu W\ cm^{-1}\ K^{-1}$"; *Cryogenics;* Bearing a date of May 1976; pp. 303-311; vol. 16.
Setia, S. et al.; "Frequency and causes of vaccine wastage"; *Vaccine*; Bearing a date of 2002; pp. 1148-1156; vol. 20; Elsevier Science Ltd.
Shu, Q. S. et al.; "Heat flux from 277 to 77 K through a few layers of multilayer insulation"; *Cryogenics;* Bearing a date of Dec. 1986; pp. 671-677; vol. 26; Butterworth & Co. Ltd.

(56) References Cited

OTHER PUBLICATIONS

Shu, Q. S. et al.; "Systematic study to reduce the effects of cracks in multilayer insulation Part 1: Theoretical model"; *Cryogenics;* Bearing a date of May 1987; pp. 249-256; vol. 27; Butterworth & Co. Ltd.
Shu, Q. S. et al.; "Systematic study to reduce the effects of cracks in multilayer insulation Part 2: experimental results"; *Cryogenics;* Bearing a date of Jun. 1987; pp. 298-311; vol. 27; No. 6; Butterworth & Co. Ltd.
Suemitsu, M. et al.; "Development of extremely high vacuums with mirror-polished Al-alloy chambers"; *Vacuum;* Bearing a date of 1993; pp. 425-428; vol. 44; No. 5-7; Pergamon Press Ltd.
Suemitsu, M. et al.; "Ultrahigh-vacuum compatible mirror-polished aluminum- alloy surface: Observation of surface-roughness-correlated outgassing rates"; *Journal of Vacuum Science Technology;* Bearing a date of May/Jun. 1992; pp. 570-572; vol. 10; No. 3; American Vacuum Society.
Tatenuma, K. et al.; "Acquisition of clean ultrahigh vacuum using chemical treatment"; *Journal of Vacuum Science Technology;* Bearing a date of Jul./Aug. 1998; pp. 2693-2697; vol. 16; No. 4; American Vacuum Society.
Tatenuma, K.; "Quick acquisition of clean ultrahigh vacuum by chemical process technology"; *Journal of Vacuum Science Technology;* Bearing a date of Jul./Aug. 1993; pp. 2693-2697; vol. 11; No. 4; American Vacuum Society.
Tripathi, A. et al.; "Hydrogen intake capacity of ZrVFe alloy bulk getters"; *Vacuum;* Bearing a date of Aug. 6, 1997; pp. 1023-1025; vol. 48; No. 12; Elsevier Science Ltd.
Watanabe, S. et al.; "Reduction of outgassing rate from residual gas analyzers for extreme high vacuum measurements"; *Journal of Vacuum Science Technology;* Bearing a date of Nov./Dec. 1996; pp. 3261-3266; vol. 14; No. 6; American Vacuum Society.
Wiedemann, C. et al.; "Multi-layer Insulation Literatures Review"; *Advances;* Printed on May 2, 2011; pp. 1-10; German Aerospace Center.
Yamazaki, K. et al.; "High-speed pumping to UHV"; *Vacuum;* Bearing a date of 2010; pp. 756-759; vol. 84; Elsevier Science Ltd.
Zalba, B. et al.; "Review on thermal energy storage with phase change: materials, heat transfer analysis and applications"; *Applied Thermal Engineering;* Bearing a date of 2003; pp. 251-283; vol. 23; Elsevier Science Ltd.
Zhitomirskij, I.S. et al.; "A theoretical model of the heat transfer processes in multilayer insulation"; *Cryogenics;* Bearing a date of May 1979; pp. 265-268; IPC Business Press.
U.S. Appl. No. 13/135,126, Deane et al.
Cabeza, L. F. et al.; "Heat transfer enhancement in water when used as PCM in thermal energy storage"; Applied Thermal Engineering; 2002; pp. 1141-1151; vol. 22; Elsevier Science Ltd.
Chen, Dexiang et al.; "Characterization of the freeze sensitivity of a hepatitis B vaccine"; Human Vaccines; Jan. 2009; pp. 26-32; vol. 5, Issue 1; Landes Bioscience.
Edstam, James S. et al.; "Exposure of hepatitis B vaccine to freezing temperatures during transport to rural health centers in Mongolia"; Preventive Medicine; 2004; pp. 384-388; vol. 39; The Institute for Cancer Prevention and Elsevier Inc.
Efe, Emine et al.; "What do midwives in one region in Turkey know about cold chain?"; Midwifery; 2008; pp. 328-334; vol. 24; Elsevier Ltd.
Günter, M. M. et al.; "Microstructure and bulk reactivity of the nonevaporable getter $Zr_{57}V_{36}Fe_7$"; J. Vac. Sci. Technol. A; Nov./Dec. 1998; pp. 3526-3535; vol. 16, No. 6; American Vacuum Society.
Hipgrave, David B. et al.; "Immunogenicity of a Locally Produced Hepatitis B Vaccine With the Birth Dose Stored Outside the Cold Chain in Rural Vietnam"; Am. J. Trop. Med. Hyg.; 2006; pp. 255-260; vol. 74, No. 2; The American Society of Tropical Medicine and Hygiene.
Hipgrave, David B. et al.; "Improving birth dose coverage of hepatitis B vaccine"; Bulletin of the World Health Organization; Jan. 2006; pp. 65-71; vol. 84, No. 1; World Health Organization.
Hobson, J. P. et al.; "Pumping of methane by St707 at low temperatures"; J. Vac. Sci. Technol. A; May/Jun. 1986; pp. 300-302; vol. 4, No. 3; American Vacuum Society.
Kendal, Alan P. et al.; "Validation of cold chain procedures suitable for distribution of vaccines by public health programs in the USA"; Vaccine; 1997; pp. 1459-1465; vol. 15, No. 12/13; Elsevier Science Ltd.
Khemis, O. et al.; "Experimental analysis of heat transfers in a cryogenic tank without lateral insulation"; Applied Thermal Engineering; 2003; pp. 2107-2117; vol. 23; Elsevier Ltd.
Li, Yang et al.; "Study on effect of liquid level on the heat leak into vertical cryogenic vessels"; Cryogenics; 2010; pp. 367-372; vol. 50; Elsevier Ltd.
Magennis, Teri et al. "Pharmaceutical Cold Chain: A Gap in the Last Mile—Part 1. Wholesaler/Distributer: Missing Audit Assurance"; Pharmaceutical & Medical Packaging News; Sep. 2010; pp. 44, 46-48, and 50; pmpnews.com.
Matolin, V. et al.; "Static SIMS study of TiZrV NEG activation"; Vacuum; 2002; pp. 177-184; vol. 67; Elsevier Science Ltd.
Nelson, Carib M. et al.; "Hepatitis B vaccine freezing in the Indonesian cold chain: evidence and solutions"; Bulletin of the World Health Organization; Feb. 2004; pp. 99-105 (plus copyright page); vol. 82, No. 2; World Health Organization.
Ren, Qian et al.; "Evaluation of an Outside-The-Cold-Chain Vaccine Delivery Strategy in Remote Regions of Western China"; Public Health Reports; Sep.-Oct. 2009; pp. 745-750; vol. 124.
Rogers, Bonnie et al.; "Vaccine Cold Chain—Part 1. Proper Handling and Storage of Vaccine"; AAOHN Journal; 2010; pp. 337-344 (plus copyright page); vol. 58, No. 8; American Association of Occupational Health Nurses, Inc.
Rogers, Bonnie et al.; Vaccine Cold Chain—Part 2. Training Personnel and Program Management; AAOHN Journal; 2010; pp. 391-402 (plus copyright page); vol. 58, No. 9; American Association of Occupational Health Nurses, Inc.
Techathawat, Sirirat et al.; "Exposure to heat and freezing in the vaccine cold chain in Thailand"; Vaccine; 2007; p. 1328-1333; vol. 25; Elsevier Ltd.
Thakker, Yogini et al.; "Storage of Vaccines in the Community: Weak Link in the Cold Chain?"; British Medical Journal; Mar. 21, 1992; pp. 756-758; vol. 304, No. 6829; BMJ Publishing Group.
Wang, Lixia et al.; "Hepatitis B vaccination of newborn infants in rural China: evaluation of a village-based, out-of-cold-chain delivery strategy"; Bulletin of the World Health Organization; Sep. 2007; pp. 688-694; vol. 85, No. 9; World Health Organization.
Wei, Wei et al.; "Effects of structure and shape on thermal performance of Perforated Multi-Layer Insulation Blankets"; Applied Thermal Engineering; 2009; pp. 1264-1266; vol. 29; Elsevier Ltd.
World Health Organization; "Guidelines on the international packaging and shipping of vaccines"; Department of Immunization, Vaccines and Biologicals; Dec. 2005; 40 pages; WHO/IVB/05.23.
U.S. Appl. No. 13/200,555, Chou et al.
U.S. Appl. No. 13/199,439, Hyde et al.
Saes Getters; "St707 Getter Alloy for Vacuum Systems"; printed on Sep. 22, 2011; pp. 1-2; located at http://www.saegetters.com/default.aspx?idPage=212.
PCT International Search Report; Application No. PCT/US2011/001939; Mar. 27, 2012; pp. 1-2.
Chinese State Intellectual Property Office; Chinese Office Action; App. No. 200880119777.2; Jan. 7, 2013 (received by our agent on Jan. 9, 2013); pp. 1-12; No English Translation Available.
Chinese State Intellectual Property Office; Office Action; App. No. 200880120366.5; Feb. 17, 2013 (received by our agent Feb. 19, 2013); pp. 1-3 (No English Translation Available).
U.S. Appl. No. 12/927,982, Deane et al.
U.S. Appl. No. 12/658,579, Deane et al.
Adams, R. O.; "A review of the stainless steel surface"; The Journal of Vacuum Science and Technology A; Bearing a date of Jan.-Mar. 1983; pp. 12-18; vol. 1, No. 1; American Vacuum Society.

(56) References Cited

OTHER PUBLICATIONS

Arora, Anubhav; Hakim, Itzhak; Baxter, Joy; Rathnasingham, Ruben; Srinivasan, Ravi; Fletcher, Daniel A.; "Needle-Free Delivery of Macromolecules Across the Skin by Nanoliter-Volume Pulsed Microjets"; PNAS Applied Biological Sciences; Mar. 13, 2007; pp. 4255-4260; vol. 104; No. 11; The National Academy of Sciences USA.
Bang, Abhay T.; Bang, Rani A.; Baitule, Sanjay B.; Reddy, M. Hanimi; Deshmukh, Mahesh D.; "Effect of Home-Based Neonatal Care and Management of Sepsis on Neonatal Mortality: Field Trial in Rural India"; The Lancet; Dec. 4, 1999; pp. 1955-1961; vol. 354; SEARCH (Society for Education, Action, and Research in Community Health).
Bartl, J., et al.; "Emissivity of aluminium and its importance for radiometric measurement"; Measurement Science Review; Bearing a date of 2004; pp. 31-36; vol. 4, Section 3.
Beavis, L. C.; "Interaction of Hydrogen with the Surface of Type 304 Stainless Steel"; The Journal of Vacuum Science and Technology; Bearing a date of Mar.-Apr. 1973; pp. 386-390; vol. 10, No. 2; American Vacuum Society.
Benvenuti, C., et al.; "Pumping characteristics of the St707 nonevaporable getter (Zr 70 V 24.6-Fe 5.4 wt %)"; The Journal of Vacuum Science and Technology A; Bearing a date of Nov.-Dec. 1996; pp. 3278-3282; vol. 14, No. 6; American Vacuum Society.
Brenzel, Logan; Wolfson, Lara J.; Fox-Rushby, Julia; Miller, Mark; Halsey, Neal A.; "Vaccine-Preventable Diseases —Chapter 20"; Disease Control Priorities in Developing Countries; printed on Oct. 15, 2007; pp. 389-411.
CDC; "Vaccine Management: Recommendations for Storage and Handling of Selected Biologicals"; Jan. 2007; 16 pages total; Department of Health & Human Services U.S.A.
Cohen, Sharon; Hayes, Janice S. Tordella, Tracey; Puente, Ivan; "Thermal Efficiency of Prewarmed Cotton, Reflective, and Forced—Warm-Air Inflatable Blankets in Trauma Patients"; International Journal of Trauma Nursing; Jan.-Mar. 2002; pp. 4-8; vol. 8; No. 1; The Emergency Nurses Association.
Cornell University Coop; "The Food Keeper"; printed on Oct. 15, 2007; 7 pages total (un-numbered).
Demko, J. A., et al.; "Design Tool for Cryogenic Thermal Insulation Systems"; Advances in Cryogenic Engineering: Transactions of the Cryogenic Engineering Conference-CEC; Bearing a date of 2008; pp. 145-151; vol. 53; American institute of Physics Services, Division of Public.
Department of Health and Social Services, Division of Public Health Section of Community Health and EMS, State of Alaska; Cold Injuries Guidelines—Alaska Multi-Level 2003 Version; bearing dates of 2003 and Jan. 2005; pp. 1-60; located at http://www.chems.alaska.gov.
Ette, Ene I.; "Conscience, the Law, and Donation of Expired Drugs"; The Annals of Pharmacotherapy; Jul./Aug. 2004; pp. 1310-1313; vol. 38.
Ferrotec; "Ferrofluid: Magnetic Liquid Technology"; bearing dates of 2001-2008; printed on Mar. 10, 2008; found at http://www.ferrotec.com/technology/ferrofluid.php.
Greenbox Systems; "Thermal Management System"; 2010; Printed on: Feb. 3, 2011; p. 1 of 1; located at http://www.greenboxsystems.com.
Horgan, A. M., et al.; "Hydrogen and Nitrogen Desorption Phenomena Associated with a Stainless Steel 304 Low Energy Electron Diffraction (LEED) and Molecular Beam Assembly"; The Journal of Vacuum Science and Technology; Bearing a date of Jul.-Aug. 1972; pp. 1218-1226; vol. 9, No. 4.
JAMC; "Preventing Cold Chain Failure: Vaccine Storage and Handling"; JAMC; Oct. 26, 2004; p. 1050; vol. 171; No. 9; Canadian Medical Association.
Jorgensen, Pernille; Chanthap, Lon; Rebueno, Antero; Tsuyuoka, Reiko; Bell, David; "Malaria Rapid Diagnostic Tests in Tropical Climates: The Need for a Cool Chain"; American Journal of Tropical Medicine and Hygiene; 2006; pp. 750-754; vol. 74; No. 5; The American Society of Tropical Medicine and Hygiene.
Kishiyama, K., et al.; "Measurement of Ultra Low Outgassing Rates for NLC UHV Vacuum Chambers"; Proceedings of the 2001 Particle Accelerator Conference, Chicago; Bearing a date of 2001; pp. 2195-2197; IEEE.
Levin, Carol E.; Nelson, Carib M.; Widjaya, Anton; Moniaga, Vanda; Anwar, Chairiyah; "The Costs of Home Delivery of a Birth Dose of Hepatitis B Vaccine in a Prefilled Syringe in Indonesia"; Bulletin of the World Health Organization; Jun. 2005; pp. 456-461 + 1 pg. Addenda; vol. 83; No. 6.
Little, Arthur D.; "Liquid Propellant Losses During Space Flight, Final Report on Contract No. NASw-615"; Bearing a date of Oct. 1964; pp. 1-315.
Llanos-Cuentas, A.; Campos, P.; Clendenes, M.; Canfield. C.J.; Hutchinson, D.B.A.; "Atovaquone and Proguanil Hydrochloride Compared with Chloroquine or Pyrimethamine/Sulfadoxine for Treatment of Acute Plasmodium Falciparum Malaria in Peru"; The Brazilian Journal of Infectious Diseases; 2001; pp. 67-72; vol. 5; No. 2; The Brazilian Journal of Infectious Diseases and Contexto Publishing.
Lockheed Missiles & Space Company; "High-Performance Thermal Protection Systems, Contract NAS 8-20758, vol. II"; Bearing a date of Dec. 31, 1969; pp. 1-117.
Lockman, Shahin; Ndase, P.; Holland, D.; Shapiro, R.; Connor, J.; Capparelli, E.; "Stability of Didanosine and Stavudine Pediatric Oral Solutions and Kaletra Capsules at Temperatures from 4°C to 55°C"; 12th Conference on Retroviruses and Opportunistic Infections, Boston, Massachusetts; Feb. 22-25, 2005; p. 1; Foundation for Retrovirology and Human Health.
Ma, Kun-Quan; and Liu, Jing; "Nano liquid-metal fluid as ultimate coolant"; Physics Letters A; bearing dates of Jul. 10, 2006, Sep. 9, 2006, Sep. 18, 2006, Sep. 26, 2006, and Jan. 29, 2007; pp. 252-256; vol. 361, Issue 3; Elsevier B.V.
Moonasar, Devanand; Goga, Ameena Ebrahim; Frean, John; Kruger, Philip; Chandramohan; Daniel; "An Exploratory Study of Factors that Affect the Performance and Usage of Rapid Diagnostic Tests for Malaria in the Limpopo Province, South Africa"; Malaria Journal; Jun. 2007; pp. 1-5; vol. 6; No. 74; Moonasar et al.; licensee BioMed Central Ltd.
Moshfegh, B.; "A New Thermal Insulation System for Vaccine Distribution; Journal of Thermal Insulation"; Jan. 1992; pp. 226-247; vol. 15; Technomic Publishing Co., Inc.
Nemanič, Vincenc, et al.; "Experiments with a thin-walled stainless-steel vacuum chamber"; The Journal of Vacuum Science and Technology A; Bearing a date of Jul.-Aug. 2000; pp. 1789-1793; vol. 18, No. 4; American Vacuum Society.
Nemanič, Vincenc, et al.; "Outgassing of a thin wall vacuum insulating panel"; Vacuum; Bearing a date of 1998; pp. 233-237; vol. 49, No. 3; Elsevier Science Ltd.
Nemanič, Vincenc, et al.; "A study of thermal treatment procedures to reduce hydrogen outgassing rate in thin wall stainless steel cells"; Vacuum; Bearing a date of 1999; pp. 277-280; vol. 53; Elsevier Science Ltd.
Nolan, Timothy D. C.; Hattler, Brack G.; Federspiel, William J.; "Development of a Balloon Volume Sensor for Pulsating Balloon Catheters"; ASIAO Journal; 2004; pp. 225-233; vol. 50; No. 3; American Society of Artificial Internal Organs.
PATH—A Catalyst for Global Health; "Uniject™ Device—The Radically Simple Uniject™ Device —Rethinking the Needle to Improve Immunization"; bearing dates of 1995-2006; printed on Oct. 11, 2007; pp. 1-2; located at http://www.path.org/projects/uniject.php; PATH Organization.
Pau, Alice K.; Moodley, Neelambal K.; Holland, Diane T.; Fomundam, Henry; Matchaba, Gugu U.; and Capparelli, Edmund V.; "Instability of lopinavir/ritonavir capsules at ambient temperatures in sub-Saharan Africa: relevance to WHO antiretroviral guidelines"; AIDS; Bearing dates of 2005, Mar. 29, 2005, and Apr. 20, 2005; pp. 1229-1236; vol. 19, No. 11; Lippincott Williams & Wilkins.
PCT International Search Report; International App. No. PCT/US09/01715; Jan. 8, 2010; pp. 1-2.
PCT International Search Report; International App. No. PCT/US08/13646; Apr. 9, 2009; pp. 1-2.
PCT International Search Report; International App. No. PCT/US08/13648; Mar. 13, 2009; pp. 1-2.

(56) References Cited

OTHER PUBLICATIONS

PCT International Search Report; International App. No. PCT/US08/13642; Feb. 26, 2009; pp. 1-2.
PCT International Search Report; International App. No. PCT/US08/13643; Feb. 20, 2009; pp. 1-2.
Pekala, R. W.; "Organic Aerogels From the Polycondensation of Resorcinol With Formaldehyde"; Journal of Materials Science; Sep. 1989; pp. 3221-3227; vol. 24; No. 9; Springer Netherlands.
Pickering, Larry K.; Wallace, Gregory; Rodewald, Lance; "Too Hot, Too Cold: Issues with Vaccine Storage"; Pediatrics®—Official Journal of the American Academy of Pediatrics; 2006; pp. 1738-1739 (4 pages total, incl. cover sheet and end page); vol. 118; American Academy of Pediatrics.
Post, Richard F.; "Maglev: A New Approach"; Scientific American; Jan. 2000; pp. 82-87; Scientific American, Inc.
Program for Appropriate Technology in Health (PATH); "The Radically Simple Uniject Device"; PATH—Reflections on Innovations in Global Health; printed on Jan. 26, 2007; pp. 1-4; located at www.path.org.
Pure Temp; "Technology"; Printed on: Feb. 9, 2011; p. 1-3; located at http://puretemp.com/technology/html.
Reeler, Anne V.; Simonsen, Lone; Health Access International; "Unsafe Injections, Fatal Infections"; Bill and Melinda Gates Children's Vaccine Program Occasional Paper #2; May 2000; pp. 1-8; located www.ChildrensVaccine.org/html/safe_injection.htm.
Risha, Peter G.; Shewiyo, Danstan; Msami, Amani; Masuki, Gerald; Vergote, Geert; Vervaet, Chris; Remon, Jean Paul; "In vitro Evaluation of the Quality of Essential Drugs on the Tanzanian Market"; Tropical Medicine and International Health; Aug. 2002; pp. 701-707; vol. 7; No. 8; Blackwell Science Ltd.
Sasaki, Y. Tito; "A survey of vacuum material cleaning procedures: A subcommittee report of the American Vacuum Society Recommended Practices Committee"; The Journal of Vacuum Science and Technology A; Bearing a date of May-Jun. 1991; pp. 2025-2035; vol. 9, No. 3; American Vacuum Society.
Seto, Joyce; Marra, Fawziah; "Cold Chain Management of Vaccines"; Continuing Pharmacy Professional Development Home Study Program; Feb. 2005; pp. 1-19; University of British Columbia.
Suttmeier, Chris; "Warm Mix Asphalt: A Cooler Alternative"; Material Matters—Around the Hot Mix Industry; Spring 2006; pp. 21-22; Peckham Materials Corporation.
Thompson, Marc T.; "Eddy current magnetic levitation—Models and experiments"; IEEE Potentials; Feb./Mar. 2000; pp. 40-46; IEEE.
"Two Wire Gage / Absolute Pressure Transmitters—Model 415 and 440"; Honeywell Sensotec; pp. 1-2; Located at www.sensotec.com and www.honeywell.com/sensing.
Unicef Regional Office for Latin America & The Carribean (Unicef-Tacro); Program for Appropriate Technology in Health (PATH); "Final Report Cold Chain Workshop," Panama City, May 31-Jun. 2, 2006; pp. 1-4 plus cover sheet, table of contents, and annexes A, B and C (22 pages total).
U.S. Department of Health and Human Services, Centers for Disease Control and Prevention; "Recommended Immunization Schedule for Persons Aged 0 Through 6 Years—United States"; Bearing a date of 2009; p. 1.
Vesel, Alenka, et al.; "Oxidation of AISI 304L stainless steel surface with atomic oxygen"; Applied Surface Science; Bearing a date of 2002; pp. 94-103; vol. 200; Elsevier Science B.V.
Williams, Preston; "Greenbox Thermal Management System Refrigerate-able 2 to 8 C Shipping Containers"; Printed on: Feb. 9, 2011; p. 1; located at http://www.puretemp.com/documents/Refrigerate-able%202%20to%208%20C%20Shipping%20Containers.pdf.
Yamakage, Michiaki; Sasaki, Hideaki; Jeong, Seong-Wook; Iwasaki, Sohshi; Namiki, Akiyoshi; "Safety and Beneficial Effect on Body Core Temperature of Prewarmed Plasma Substitute Hydroxyethyl Starch During Anesthesia" [Abstract]; Anesthesiology; 2004; p. A-1285; vol. 101; ASA.
Young, J. R.; "Outgassing Characteristics of Stainless Steel and Aluminum with Different Surface Treatments"; The Journal of Vacuum Science and Technology; Bearing a date of Oct. 14, 1968; pp. 398-400; vol. 6, No. 3.
Zajec, Bojan, et al.; "Hydrogen bulk states in stainless-steel related to hydrogen release kinetics and associated redistribution phenomena"; Vacuum; Bearing a date of 2001; pp. 447-452; vol. 61; Elsevier Science Ltd.
Zhu, Z. Q.; Howe, D.; "Halbach Permanent Magnet Machines and Applications: A Review"; IEE Proceedings—Electric Power Applications; Jul. 2001; pp. 299-308; vol. 148; No. 4; University of Sheffield, Department of Electronic & Electrical Engineering, Sheffield, United Kingdom.
Chinese State Intellectual Property Office; First Office Action; App No. 200880119918.0; Jul. 13, 2011.
Chinese State Intellectual Property Office; App. No. 200880119777.2; Mar. 30, 2012; pp. 1-10 (no translation available).
Winn, Joshua N. et al.; "Omnidirectional reflection from a one-dimensional photonic crystal"; Optics Letters; Oct. 15, 1998; pp. 1573-1575; vol. 23, No. 20; Optical Society of America.
Chinese Office Action; Application No. 200880120367.X; Oct. 25, 2012 (received by our agent on Oct. 29, 2012); pp. 1-5; No English Translation Provided.
U.S. Appl. No. 13/720,328, Hyde et al.
U.S. Appl. No. 13/720,256, Hyde et al.
Chinese State Intellectual Property Office; Office Action; App. No. 200880119918.0; May 27, 2013 (received by our agent on May 29, 2013); 9 pages (No English Translation Available).
U.S. Appl. No. 13/385,088, Hyde et al.
U.S. Appl. No. 13/374,218, Hyde et al.
Intellectual Property Office of the People's Republic of China; Office Action; Chinese Application No. 200880119918.0; Dec. 12, 2012; pp. 1-11.
U.S. Appl. No. 14/098,886, Bloedow et al.
U.S. Appl. No. 14/070,892, Hyde et al.
U.S. Appl. No. 14/070,234, Hyde et al.
Chinese State Intellectual Property Office; Office Action; App. No. 200880120366.5; Jun. 27, 2013; 3 pages (no English translation available).
U.S. Appl. No. 13/853,245, Eckhoff et al.
BINE Informationsdienst; "Zeolite/water refrigerators, Projekt*info* 16/10"; BINE Information Service; printed on Feb. 12, 2013; pp. 1-4; FIZ Karlsruhe, Germany; located at: http://www.bine.info/fileadmin/content/Publikationen/Englische_Infos/projekt_1610_engl_internetx.pdf.
Conde-Petit, Manuel R.; "Aqueous solutions of lithium and calcium chlorides:—Property formulations for use in air conditioning equipment design"; 2009; pp. 1-27 plus two cover pages; M. Conde Engineering, Zurich, Switzerland.
Cool-System Keg GmbH; "Cool-System presents: CoolKeg® The world's first self-chilling Keg!"; printed on Feb. 6, 2013; pp. 1-5; located at: http://www.coolsystem.de/.
Dawoud, et al.; "Experimental study on the kinetics of water vapor sorption on selective water sorbents, silica gel and alumina under typical operating conditions of sorption heat pumps"; International Journal of Heat and Mass Transfer; 2003; pp. 273-281; vol. 46; Elsevier Science Ltd.
Dometic S.A.R.L.; "Introduction of Zeolite Technology into refrigeration systems, LIFE04 ENV/LU/000829, Layman's Report"; printed on Feb. 6, 2013; pp. 1-10; located at: http://ec.europa.eu/environment/life/projec t/Projects/index.cfm?fuseaction=home.showFile&rep=file&fil=LIFE04_ENV_LU_000829_LAYMAN.pdf.
Dow Chemical Company; "Calcium Chloride Handbook: A Guide to Properties, Forms, Storage and Handling"; Aug. 2003; pp. 1-28.
Gast Manufacturing, Inc.; "Vacuum and Pressure Systems Handbook"; printed on Jan. 3, 2013; pp. 1-20; located at: http://www.gastmfg.com/vphb/vphb_s1.pdf.
Gea Wiegand; "Pressure loss in vacuum lines with water vapour"; printed on Mar. 13, 2013; pp. 1-2; located at: http://produkte.gea-wiegand.de/GEA/GEACategory/139/index_en.html.

(56) References Cited

OTHER PUBLICATIONS

Hall, Larry D.; "Building Your Own Larry Hall Icyball"; printed on Mar. 27, 2013; pp. 1-4; located at: http://crosleyautoclub.com/IcyBall/HomeBuilt/HallPlans/IB_Directions.html.
Kozubal, et al.; "Desiccant Enhanced Evaporative Air-Conditioning (DEVap): Evaluation of a New Concept in Ultra Efficient Air Conditioning, Technical Report NREL/TP-5500-49722"; National Renewable Energy Laboratory; Jan. 2011; pp. i-vii, 1-60, plus three cover pages and Report Documentation Page.
Machine-History.com; "Refrigeration Machines"; printed on Mar. 27, 2013; pp. 1-10; located at: http://www.machine-history.com/Refrigeration%20Machines.
Marquardt, Niels; "Introduction to the Principles of Vacuum Physics"; 1999; pp. 1-24; located at: http://www.cientificosaficionados.com/libros/CERN/vaciol-CERN.pdf.
Modern Mechanix; "Icyball Is Practical Refrigerator for Farm or Camp Use (Aug. 1930)"; bearing a date of Aug. 1930; printed on Mar. 27, 2013; pp. 1-3; located at: http://blog.modernmechanix.com/icyball-is-practical-refrigerator-for-farm-or-camp-use/.
NSM Archive; "Band structure and carrier concentration"; date of Jan. 22, 2004 provided by examiner, printed on Feb. 16, 2013; pp. 1-10, 1 additional page of archive information; located at: http://web.archive.org/20040122200811/http://www.ioffe.rssi.ru/SVA/NSM/Semicond/SiC/bandstr.html
Oxychem; "Calcium Chloride, A Guide to Physical Properties"; printed on Jan. 3, 2013; pp. 1-9, plus two cover pages and back page; Occidental Chemical Corporation; located at: http://www.cal-chlor.com/PDF/GUIDE-physical- properties.pdf.
Restuccia, et al.; "Selective water sorbent for solid sorption chiller: experimental results and modeling"; International Journal of Refrigeration; 2004; pp. 284-293; vol. 27; Elsevier Ltd and IIR.
Rezk, et al.; "Physical and operating conditions effects on silica gel/water adsorption chiller performance"; Applied Energy; 2012; pp. 142-149; vol. 89; Elsevier Ltd.
Rietschle Thomas; "Calculating Pipe Size & Pressure Drops in Vacuum Systems, Section 9—Technical Reference"; printed on Jan. 3, 2013; pp. 9-5 through 9-7; located at: http://www.ejglobalinc.com/Tech.htm.
Saha, et al.; "A new generation of cooling device employing $CaCl_2$-in-silica gel-water system"; International Journal of Heat and Mass Transfer; 2009; pp. 516-524; vol. 52; Elsevier Ltd.
Uop; "An Introduction to Zeolite Molecular Sieves"; printed on Jan. 10, 2013; pp. 1-20; located at: http://www.eltrex.pl/pdf/karty/adsorbenty/ENG-Introduction%20to%20Zeolite%20Molecular%20Sieves.pdf.
Wang, et al.; "Study of a novel silica gel-water adsorption chiller. Part I. Design and performance prediction"; International Journal of Refrigeration; 2005; pp. 1073-1083; vol. 28; Elsevier Ltd and IIR.
Wikipedia; "Icyball"; Mar. 14, 2013; printed on Mar. 27, 2013; pp. 1-4; located at: http://en.wikipedia.org/wiki/Icyball.
Chinese State Intellectual Property Office; Office Action; App. No. 200880120366.5; Jun. 1, 2012; pp. 1-19 (no English translation available)
Chinese State Intellectual Property Office, Office Action; App. No. 201180016103.1 (based on PCT Patent Application No. PCT/US2011/000234); Jun. 23, 2014 (received by our Agent on Jun. 25, 2014); pp. 1-23.
"About Heat Leak—Comparison"; Technifab Products, Inc.; printed on Jun. 25, 2014; 2 pages; located at www.technifab.com/cryogenic-resource-library/about-heat-leak.html.
PCT International Search Report; International App. No. PCT/US2014/067863; Mar. 27, 2015; pp. 1-3.

* cited by examiner

TEMPERATURE-STABILIZED STORAGE SYSTEMS WITH FLEXIBLE CONNECTORS

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)). All subject matter of the Related Applications and of any and all parent, grandparent, great-grandparent, etc. applications of the Related Applications, including any priority claims, is incorporated herein by reference to the extent such subject matter is not inconsistent herewith.

RELATED APPLICATIONS

For purposes of the USPTO extra-statutory requirements, the present application constitutes a continuation-in-part of U.S. patent application Ser. No. 12/001,757, entitled TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 11, 2007, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/006,088, entitled TEMPERATURE-STABILIZED STORAGE CONTAINERS WITH DIRECTED ACCESS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 27, 2007 now U.S. Pat. No. 8,215,518, or is an application of which a currently co-pending application is entitled to the benefit of the filing date.

For purposes of the USPTO extra-statutory requirements, the present application constitutes a continuation-in-part of U.S. patent application Ser. No. 12/006,089, entitled TEMPERATURE-STABILIZED STORAGE SYSTEMS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 27, 2007, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/008,695, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Jan. 10, 2008 now U.S. Pat. No. 8,377,033, or is an application of which a currently co-pending application is entitled to the benefit of the filing date.

For purposes of the USPTO extra-statutory requirements, the present application constitutes a continuation-in-part of U.S. patent application Ser. No. 12/012,490, entitled METHODS OF MANUFACTURING TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Jan. 31, 2008 now U.S. Pat. No. 8,069,680, or is an application of which a currently co-pending application is entitled to the benefit of the filing date.

For purposes of the USPTO extra-statutory requirements, the present application constitutes a continuation-in-part of U.S. patent application Ser. No. 12/077,322, entitled TEMPERATURE-STABILIZED MEDICINAL STORAGE SYSTEMS, naming Roderick A. Hyde; Edward K. Y. Jung; Nathan P. Myhrvold; Clarence T. Tegreene; William Gates; Charles Whitmer; and Lowell L. Wood, Jr. as inventors, filed Mar. 17, 2008 now U.S. Pat. No. 8,215,835, or is an application of which a currently co-pending application is entitled to the benefit of the filing date.

For purposes of the USPTO extra-statutory requirements, the present application constitutes a continuation-in-part of U.S. patent application Ser. No. 12/152,465, entitled STORAGE CONTAINER INCLUDING MULTI-LAYER INSULATION COMPOSITE MATERIAL HAVING BANDGAP MATERIAL AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed May 13, 2008 now U.S. Pat. No. 8,485,387, or is an application of which a currently co-pending application is entitled to the benefit of the filing date.

For purposes of the USPTO extra-statutory requirements, the present application constitutes a continuation-in-part of U.S. patent application Ser. No. 12/152,467, entitled MULTI-LAYER INSULATION COMPOSITE MATERIAL INCLUDING BANDGAP MATERIAL, STORAGE CONTAINER USING SAME, AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed May 13, 2008 now U.S. Pat. No. 8,211,516, or is an application of which a currently co-pending application is entitled to the benefit of the filing date.

For purposes of the USPTO extra-statutory requirements, the present application constitutes a continuation-in-part of U.S. patent application Ser. No. 12/220,439, entitled MULTI-LAYER INSULATION COMPOSITE MATERIAL HAVING AT LEAST ONE THERMALLY-REFLECTIVE LAYER WITH THROUGH OPENINGS, STORAGE CONTAINER USING SAME, AND RELATED METHODS, naming Roderick A. Hyde; Muriel Y. Ishikawa; Jordin T. Kare; and Lowell L. Wood, Jr. as inventors, filed Jul. 23, 2008 now U.S. Pat. No. 8,603,598, or is an application of which a currently co-pending application is entitled to the benefit of the filing date.

For purposes of the USPTO extra-statutory requirements, the present application constitutes a continuation-in-part of U.S. patent application Ser. No. 12/658,579, entitled TEMPERATURE-STABILIZED STORAGE SYSTEMS, naming Geoffrey F. Deane; Lawrence Morgan Fowler; William Gates; Zihong Guo; Roderick A. Hyde; Edward K. Y. Jung; Jordin T. Kare; Nathan P. Myhrvold; Nathan Pegram; Nels R. Peterson; Clarence T. Tegreene; Charles Whitmer; and Lowell L. Wood, Jr. as inventors, filed Feb. 8, 2010, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/927,982, entitled TEMPERATURE-STABILIZED STORAGE SYSTEMS INCLUDING STORAGE STRUCTURES CONFIGURED FOR INTERCHANGEABLE STORAGE OF MODULAR UNITS, naming Geoffrey F. Deane; Lawrence Morgan Fowler; William Gates; Jenny Ezu Hu; Roderick A. Hyde; Edward K. Y. Jung; Jordin T. Kare; Nathan P. Myhrvold; Nathan Pegram; Nels R. Peterson; Clarence T. Tegreene; Charles Whitmer; and Lowell L. Wood, Jr. as inventors, filed Nov. 29, 2010, which is currently co-pending, or is an application of which a currently co-pending application is entitled to the benefit of the filing date.

The United States Patent Office (USPTO) has published a notice to the effect that the USPTO's computer programs require that patent applicants reference both a serial number and indicate whether an application is a continuation, continuation-in-part, or divisional of a parent application. Stephen G. Kunin, *Benefit of Prior-Filed Application*, USPTO Official Gazette Mar. 18, 2003. The present Applicant Entity (hereinafter "Applicant") has provided above a specific reference to the application(s) from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant has provided designation(s) of a relationship between the present application and its parent application(s) as set forth above, but expressly points out that such designation(s) are not to be construed in any way as any type of commentary and/or admission as to whether or not the present application contains any new matter in addition to the matter of its parent application(s).

SUMMARY

Flexible connectors for use with substantially thermally sealed storage containers are described herein. In some embodiments, a substantially thermally sealed storage container includes a flexible connector joining an aperture in an exterior of a substantially thermally sealed storage container to an aperture in a substantially thermally sealed storage region within the container. In these embodiments, the flexible connector includes a duct forming an elongated thermal pathway between the exterior of the container and the substantially thermally sealed storage region, the duct substantially defining a conduit between the exterior of the substantially thermally sealed storage container and the aperture on the substantially thermally sealed storage region, a first compression unit configured to mate with a first end of the duct, a second compression unit configured to mate with a second end of the duct, and a plurality of compression strands connected between the first compression unit and the second compression unit.

In some embodiments, a substantially thermally sealed storage container includes an outer wall substantially defining a substantially thermally sealed storage container, the outer wall substantially defining a single outer wall aperture, an inner wall substantially defining a substantially thermally sealed storage region within the substantially thermally sealed storage container, the inner wall substantially defining a single inner wall aperture, a gap between the inner wall and the outer wall, at least one section of ultra efficient insulation material within the gap; and a flexible connector joining the single outer wall aperture and the single inner wall aperture. In these embodiments, the flexible connector includes a duct substantially defining a conduit including an extended thermal pathway, a first compression unit configured to mate with a first end of the duct, a second compression unit configured to mate with a second end of the duct, and a plurality of compression strands connected between the first compression unit and the second compression unit.

In some embodiments, a substantially thermally sealed storage container includes an outer wall substantially defining a substantially thermally sealed storage container, the outer wall substantially defining a single outer wall aperture, an inner wall substantially defining a substantially thermally sealed storage region within the substantially thermally sealed storage container, the inner wall substantially defining a single inner wall aperture, a gap between the inner wall and the outer wall, at least one layer of multilayer insulation material within the gap, the at least one layer of multilayer insulation material substantially surrounding the inner wall, a pressure less than or equal to $5\times10^{-4}$ torr in the gap; and a flexible connector joining the single outer wall aperture and the single inner wall aperture. In these embodiments, the flexible connector includes a duct substantially defining a conduit including an extended thermal pathway, a first compression unit configured to mate with a first end of the duct, a second compression unit configured to mate with a second end of the duct, and a plurality of compression strands connecting the first compression unit and the second compression unit.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
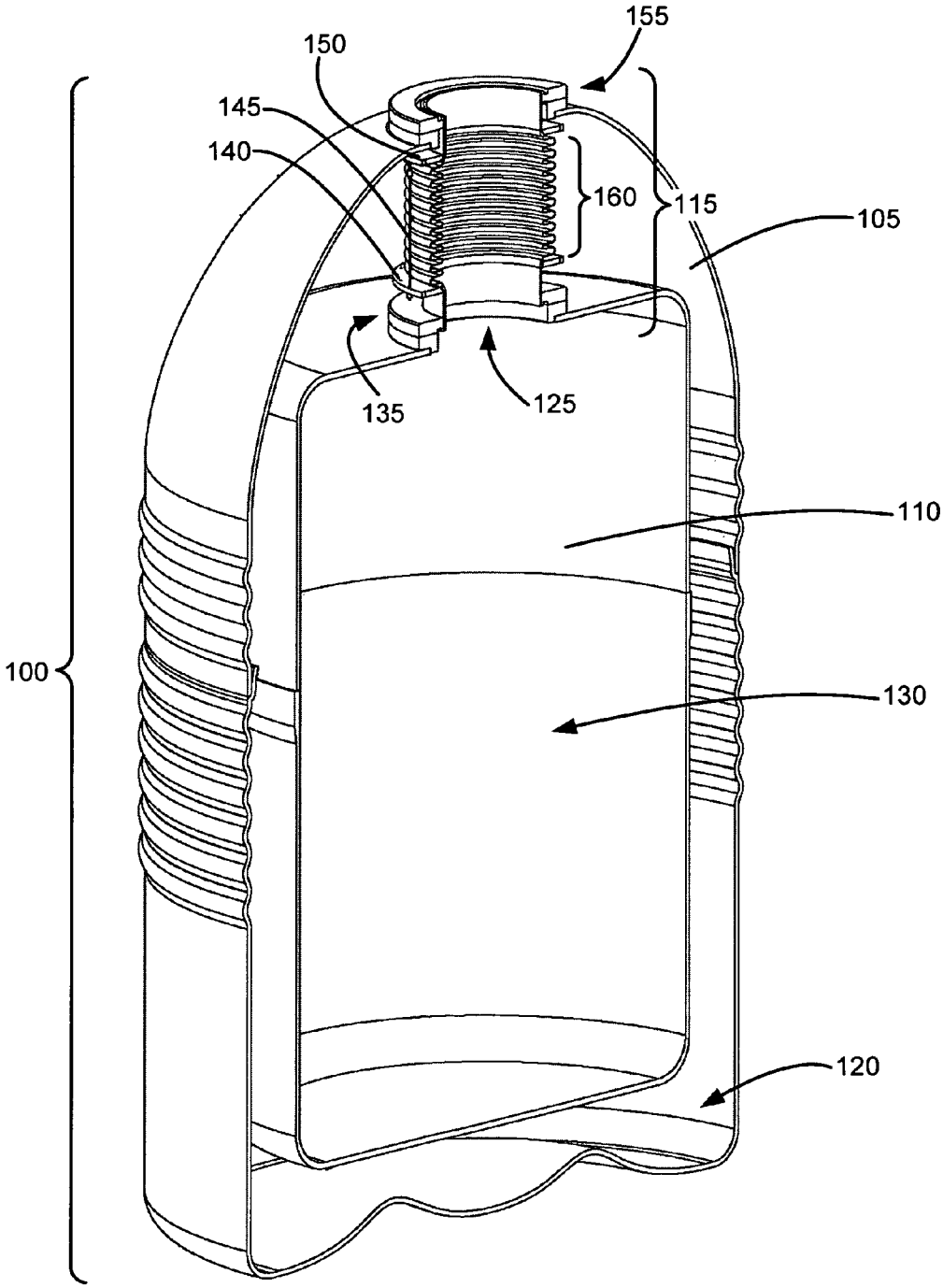
FIG. 1 illustrates a cross-section view of a vertically upright, substantially thermally sealed storage container including a flexible connector.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The use of the same symbols in different drawings typically indicates similar or identical items.

With reference now to FIG. 1, shown is an example of a substantially thermally sealed storage container 100 including a flexible connector 115 that may serve as a context for introducing one or more processes and/or devices described herein. FIG. 1 depicts a vertically upright, substantially thermally sealed storage container 100 including a flexible connector 115. For the purposes of illustration in FIG. 1, the container 100 is depicted in cross-section to view interior aspects. A substantially thermally sealed storage container 100 includes at least one substantially thermally sealed storage region 130 with extremely low heat conductance and extremely low heat radiation transfer between the outside environment of the container and the area internal to the at least one substantially thermally sealed storage region 130. A substantially thermally sealed storage container 100 is configured for extremely low heat conductance and extremely low heat radiation transfer between the outside environment of the substantially thermally sealed storage container 100 and the inside of a substantially thermally sealed storage region 130. For example, in some embodiments the heat leak between a substantially thermally sealed storage region 130 and the exterior of the substantially thermally sealed storage container 100 is less than 1 Watt (W) when the exterior of the container is at a temperature of approximately 40 degrees Centigrade (C) and the substantially thermally sealed storage region is maintained at a temperature between 0 degrees C. and 10 degrees C. For example, in some embodiments the heat leak between a substantially thermally sealed storage region 130 and the exterior of the substantially thermally sealed storage container 100 is less than 700 mW when the exterior of the container is at a temperature of approximately 40 degrees Centigrade (C) and the substantially thermally sealed storage region is maintained at a temperature between 0 degrees C. and 10 degrees C. For example, in some embodiments the heat leak between a substantially thermally sealed storage region 130 and the exterior of the substantially thermally sealed storage container 100 is less than 600 mW when the exterior of the container is at a temperature of approximately 40 degrees Centigrade (C) and the substantially thermally sealed storage region is maintained at a temperature between 0 degrees C. and 10 degrees C. For example, in some embodiments the heat leak between a substantially thermally sealed storage region 130 and the exterior of the substantially thermally sealed storage container 100 is approximately 500 mW when the exterior of the container is at a temperature of approximately 40 degrees Centigrade (C) and the substantially thermally sealed storage region is maintained at a temperature between 0 degrees C. and 10 degrees C. A substantially thermally sealed storage container 100 may be configured for transport and storage of material in a predetermined temperature range within a substantially thermally sealed storage region 130 for a period of time without active cooling or an active cooling unit. For example, a substantially thermally sealed storage container 100 in an external temperature of approximately 40 degrees C. may be configured for transport and storage of material in a temperature range between 0 degrees C. and 10 degrees C. within a substantially thermally sealed storage region 130 for up to three months. For example, a substantially thermally sealed storage container 100 in an external temperature of approximately 40 degrees C. may be configured for transport and storage of material in a temperature range between 0 degrees C. and 10 degrees C. within a substantially thermally sealed storage region 130 for up to two months. For example, a substantially thermally sealed storage container 100 in an external temperature of approximately 40 degrees C. may be configured for transport and storage of material in a temperature range between 0 degrees C. and 10 degrees C. within a substantially thermally sealed storage region 130 for up to one month. Specific thermal properties and storage capabilities of a substantially thermally sealed storage container 100 vary depending on the specific embodiment. For example, factors such as the materials used in fabrication of the substantially thermally sealed storage container 100, the design, and expected external temperature for use of the container will affect the specific thermal properties and storage capabilities of a substantially thermally sealed storage container 100.

The substantially thermally sealed storage container 100 may be of a portable size and shape, for example a size and shape within expected portability estimates for an individual person. The substantially thermally sealed storage container 100 may be configured for both transport and storage of material. The substantially thermally sealed storage container 100 may be configured of a size and shape for carrying, lifting or movement by an individual person. For example, in some embodiments the substantially thermally sealed storage container 100 has a mass that is less than approximately 50 kilograms (kg), or less than approximately 30 kg. For example, in some embodiments a substantially thermally sealed storage container 100 has a length and width that are less than approximately 1 meter (m). For example, implementations of a substantially thermally sealed storage container 100 may include dimensions on the order of 45 centimeters (cm) in diameter and 70 cm in height. The substantially thermally sealed storage container 100 illustrated in FIG. 1 is roughly configured as an oblong shape, however multiple shapes are possible depending on the embodiment. For example, a rectangular shape, or an irregular shape, may be desirable in some embodiments, depending on the intended use of the substantially thermally sealed storage container 100. For example, a substantially round or ball-like shape of a substantially thermally sealed storage container 100 may be desirable in some embodiments.

Figure 8:
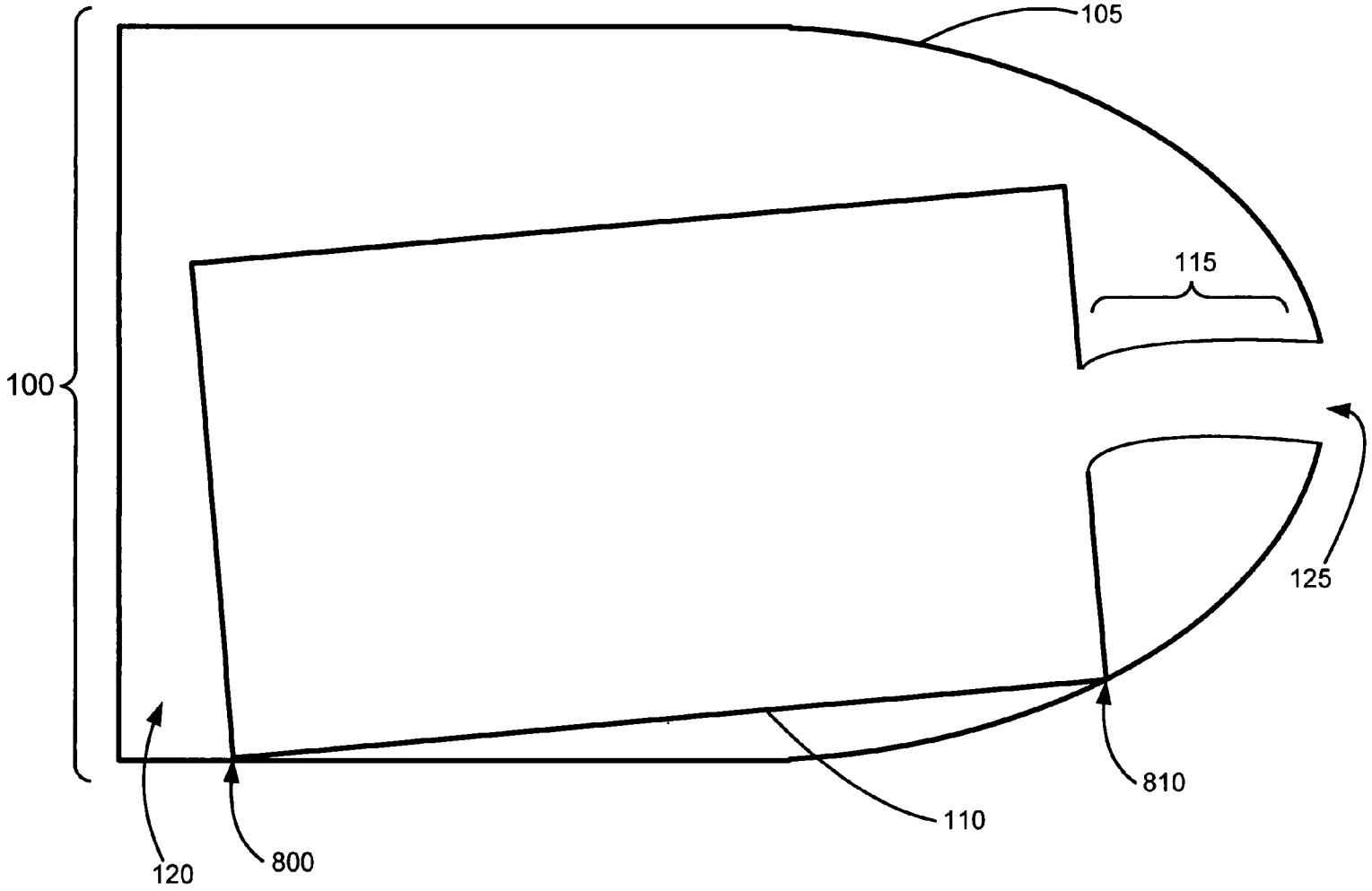
FIG. 8 shows a cross-section view of a horizontally positioned, substantially thermally sealed storage container including a flexible connector.
Figure 9:
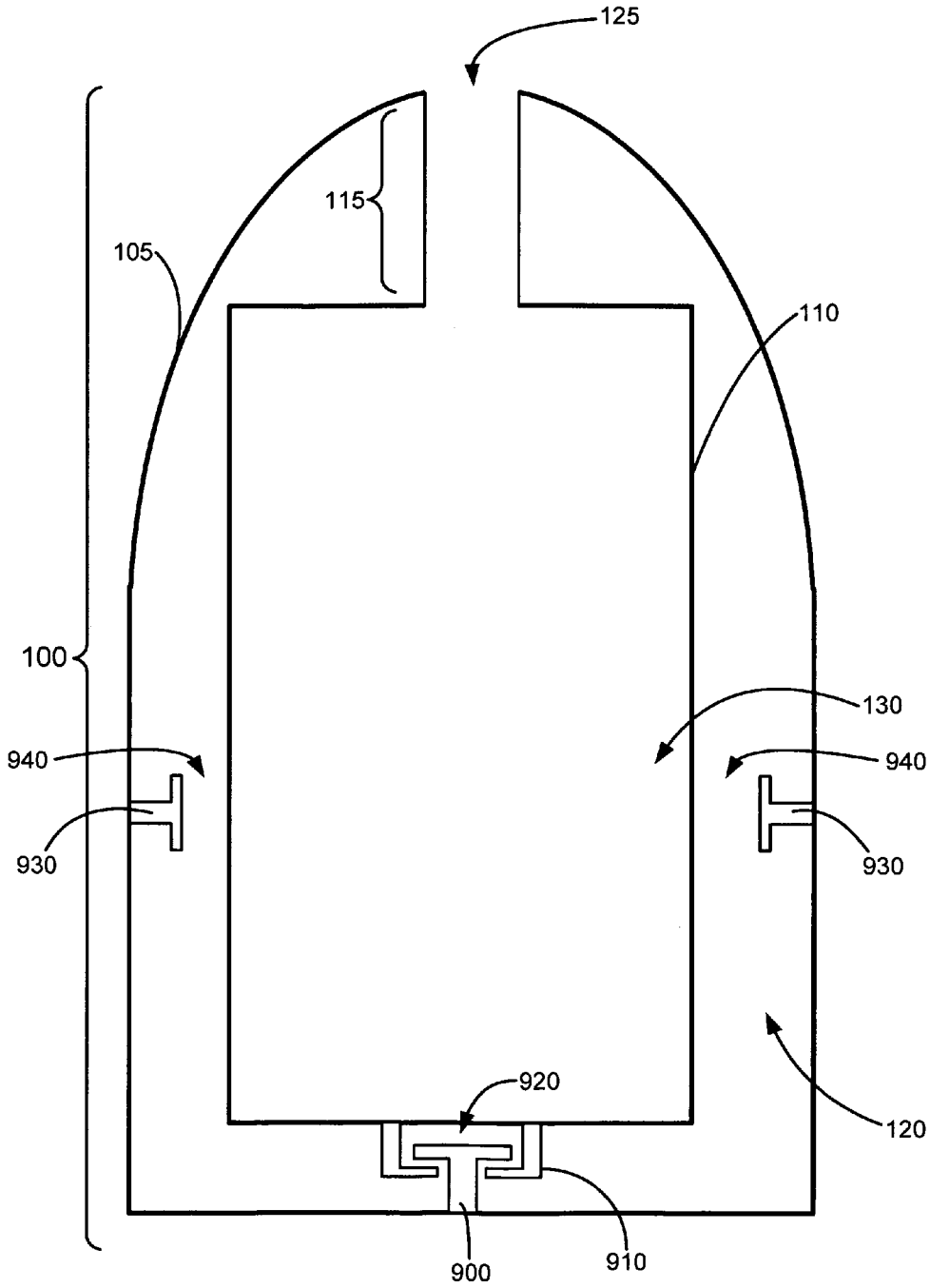
FIG. 9 illustrates a cross-section view of a substantially thermally sealed storage container, including restraining units, in an upright position.

As shown in FIGS. 1, 8 and 9, some embodiments include a substantially thermally sealed storage container that includes zero active cooling units. For example, no active cooling units are included in the illustrations of any of FIGS. 1, 8 and 9. The term "active cooling unit," as used herein, includes conductive and radiative cooling mechanisms that require electricity from an external source to operate. For example, active cooling units may include one or more of actively powered fans, actively pumped refrigerant systems, thermoelectric systems, active heat pump systems, active vapor-compression refrigeration systems and active heat exchanger systems. The external energy required to operate such mechanisms may originate, for example, from municipal electrical power supplies or electric batteries.

In some embodiments the substantially thermally sealed storage container may include one or more heat sink units thermally connected to one or more storage region 130. In some embodiments, the substantially thermally sealed storage container 100 may include no heat sink units. In some embodiments, the substantially thermally sealed storage container 100 may include heat sink units within the interior of the container 100, such as within a storage region 130. The term "heat sink unit," as used herein, includes one or more units that absorb thermal energy. See, for example, U.S. Pat. No. 5,390,734 to Voorhes et al., titled "Heat Sink," U.S. Pat.

No. 4,057,101 to Ruka et al., titled "Heat Sink," U.S. Pat. No. 4,003,426 to Best et al., titled "Heat or Thermal Energy Storage Structure," and U.S. Pat. No. 4,976,308 to Faghri titled "Thermal Energy Storage Heat Exchanger," which are each incorporated herein by reference. Heat sink units may include, for example: units containing frozen water or other types of ice; units including frozen material that is generally gaseous at ambient temperature and pressure, such as frozen carbon dioxide ($CO_2$); units including liquid material that is generally gaseous at ambient temperature and pressure, such as liquid nitrogen; units including artificial gels or composites with heat sink properties; units including phase change materials; and units including refrigerants. See, for example: U.S. Pat. No. 5,261,241 to Kitahara et al., titled "Refrigerant," U.S. Pat. No. 4,810,403 to Bivens et al., titled "Halocarbon Blends for Refrigerant Use," U.S. Pat. No. 4,428,854 to Enjo et al., titled "Absorption Refrigerant Compositions for Use in Absorption Refrigeration Systems," and U.S. Pat. No. 4,482,465 to Gray, titled "Hydrocarbon-Halocarbon Refrigerant Blends," which are each herein incorporated by reference.

As depicted in FIG. 1, the substantially thermally sealed storage container 100 includes an outer wall 105. The outer wall 105 substantially defines the substantially thermally sealed storage container 100, and the outer wall 105 substantially defines a single outer wall aperture. As illustrated in FIG. 1, the substantially thermally sealed storage container 100 includes an inner wall 110. The inner wall 110 substantially defines a substantially thermally sealed storage region 130 within the substantially thermally sealed storage container 100, and the inner wall 110 substantially defines a single inner wall aperture. As illustrated in FIG. 1, the substantially thermally sealed storage container 100 may be configured so that the aperture in the outer wall 105 is located at the top of the container during use of the container. The substantially thermally sealed storage container 100 may be configured so that an aperture in the outer wall 105 is at the top edge of the outer wall 105 during routine storage or use of the container. The substantially thermally sealed storage container 100 may be configured so that an aperture in the exterior of the container connecting to the conduit 125 is at the top edge of the container 100 during storage of the container 100. The substantially thermally sealed storage container 100 may be configured so that an aperture in the outer wall 105 is at an opposing face of the container 100 as a base or bottom support structure of the container 100. The substantially thermally sealed storage container 100 may be configured so that an aperture in the outer wall 105 is at an opposing face of the container 100 as a support structure on a lower portion of the container 100. Embodiments wherein the substantially thermally sealed storage container 100 is configured so that an aperture in the outer wall 105 is at the top edge of the outer wall 105 during routine storage or use of the container may be configured for minimal passive transfer of thermal energy from the region exterior to the container. For example, a substantially thermally sealed storage container 100 configured so that an aperture in the outer wall 105 is at an opposing face of the container 100 as a base or bottom support structure of the container 100 may also be configured so that thermal energy radiating from a floor or surface under the container 100 does not directly radiate into the aperture in the outer wall 105.

Although the substantially thermally sealed storage container 100 depicted in FIG. 1 includes a single substantially thermally sealed storage region 130, in some embodiments a substantially thermally sealed storage container 100 may include a plurality of substantially thermally sealed storage regions. In some embodiments, there may be a substantially thermally sealed storage container 100 including a plurality of storage regions (e.g. 130) within the container. The plurality of storage regions may be, for example, of comparable size and shape or they may be of differing sizes and shapes as appropriate to the embodiment. Different storage regions may include, for example, various removable inserts, at least one layer including at least one metal on the interior surface of a storage region, or at least one layer of nontoxic material on the interior surface, in any combination or grouping. Although the substantially thermally sealed storage region 130 depicted in FIG. 1 is approximately cylindrical in shape, a substantially thermally sealed storage region 130 may be of a size and shape appropriate for a specific embodiment. For example, a substantially thermally sealed storage region 130 may be oblong, round, rectangular, square or of irregular shape. A substantially thermally sealed storage region 130 may vary in total volume, depending on the embodiment and the total dimensions of the container 100. For example, a substantially thermally sealed storage container 100 configured for portability by an individual person may include a substantially thermally sealed storage region 130 with a total volume less than 30 liters (L), for example a volume of 25 L or 20 L. For example, a substantially thermally sealed storage container 100 configured for transport on a vehicle may include a substantially thermally sealed storage region 130 with a total volume more than 30 L, for example 35 L or 40 L. A substantially thermally sealed storage region 130 may include additional structure as appropriate for a specific embodiment. For example, a substantially thermally sealed storage region may include stabilizing structures, insulation, packing material, or other additional components configured for ease of use or stable storage of material.

In some embodiments, a substantially thermally sealed container 100 includes at least one layer of nontoxic material on an interior surface of one or more substantially thermally sealed storage region 130. Nontoxic material may include, for example, material that does not produce residue that may be toxic to the contents of the at least one substantially thermally sealed storage region 130, or material that does not produce residue that may be toxic to the future users of contents of the at least one substantially thermally sealed storage region 130. Nontoxic material may include material that maintains the chemical structure of the contents of the at least one substantially thermally sealed storage region 130, for example nontoxic material may include chemically inert or non-reactive materials. Nontoxic material may include material that has been developed for use in, for example, medical, pharmaceutical or food storage applications. Nontoxic material may include material that may be cleaned or sterilized, for example material that may be irradiated, autoclaved, or disinfected. Nontoxic material may include material that contains one or more antibacterial, antiviral, antimicrobial, or antipathogen agents. For example, nontoxic material may include aldehydes, hypochlorites, oxidizing agents, phenolics, quaternary ammonium compounds, or silver. Nontoxic material may include material that is structurally stable in the presence of one or more cleaning or sterilizing compounds or radiation, such as plastic that retains its structural integrity after irradiation, or metal that does not oxidize in the presence of one or more cleaning or sterilizing compounds. Nontoxic material may include material that consists of multiple layers, with layers removable for cleaning or sterilization, such as for reuse of the at least one substantially thermally sealed storage region. Nontoxic material may include, for example, material including metals, fabrics, papers or plastics.

In some embodiments, a substantially thermally sealed container 100 includes at least one layer including at least one metal on an interior surface of at least one thermally sealed storage region 130. For example, the at least one metal may include gold, aluminum, copper, or silver. The at least one metal may include at least one metal composite or alloy, for example steel, stainless steel, metal matrix composites, gold alloy, aluminum alloy, copper alloy, or silver alloy. In some embodiments, the at least one metal includes metal foil, such as titanium foil, aluminum foil, silver foil, or gold foil. A metal foil may be a component of a composite, such as, for example, in association with polyester film, such as polyethylene terephthalate (PET) polyester film. The at least one layer including at least one metal on the interior surface of at least one storage region 130 may include at least one metal that may be sterilizable or disinfected. For example, the at least one metal may be sterilizable or disinfected using plasmons. For example, the at least one metal may be sterilizable or disinfected using autoclaving, thermal means, or chemical means. Depending on the embodiment, the at least one layer including at least one metal on the interior surface of at least one storage region may include at least one metal that has specific heat transfer properties, such as a thermal radiative properties.

In some embodiments, a substantially thermally sealed storage container 100 includes one or more storage structures within an interior of at least one thermally sealed storage region 130. For example, a storage structure may include racks, shelves, containers, thermal insulation, shock insulation, or other structures configured for storage of material within the storage region 130. In some embodiments, a substantially thermally sealed storage container 100 includes one or more removable inserts within an interior of at least one thermally sealed storage region 130. The removable inserts may be made of any material appropriate for the embodiment, including metal, alloy, composite, or plastic. The removable inserts may be made of any material appropriate for the embodiment, including nontoxic materials. The one or more removable inserts may include inserts that may be reused or reconditioned. The one or more removable inserts may include inserts that may be cleaned, sterilized, or disinfected as appropriate to the embodiment.

In some embodiments, the container 100 may be configured for storage of one or more medicinal units within a storage region 130. For example, some medicinal units are optimally stored within approximately 0 degrees Centigrade and approximately 10 degrees Centigrade. For example, some medicinal units are optimally stored within approximately 2 degrees Centigrade and approximately 8 degrees Centigrade. See: Chen and Kristensen, "Opportunities and Challenges of Developing Thermostable Vaccines," *Expert Rev. Vaccines,* 8(5), pages 547-557 (2009); Matthias et al., "Freezing Temperatures in the Vaccine Cold Chain: A Systematic Literature Review," *Vaccine* 25, pages 3980-3986 (2007); Wirkas et al., "A Vaccines Cold Chain Freezing Study in PNG Highlights Technology Needs for Hot Climate Countries," *Vaccine* 25, pages 691-697 (2007); the WHO publication titled "Preventing Freeze Damage to Vaccines," publication no. WHO/IVB/07.09 (2007); and the WHO publication titled "Temperature Sensitivity of Vaccines," publication no. WHO/IVB/06.10 (2006), which are all herein incorporated by reference.

The term "medicinal", as used herein, includes a drug, composition, formulation, material or compound intended for medicinal or therapeutic use. For example, a medicinal may include drugs, vaccines, therapeutics, vitamins, pharmaceuticals, remedies, homeopathic agents, naturopathic agents, or treatment modalities in any form, combination or configuration. For example, a medicinal may include vaccines, such as: a vaccine packaged as an oral dosage compound, vaccine within a prefilled syringe, a container or vial containing vaccine, vaccine within a unijet device, or vaccine within an externally deliverable unit (e.g. a vaccine patch for transdermal applications). For example, a medicinal may include treatment modalities, such as: antibody therapies, small-molecule compounds, anti-inflammatory agents, therapeutic drugs, vitamins, or pharmaceuticals in any form, combination or configuration. A medicinal may be in the form of a liquid, gel, solid, semi-solid, vapor, or gas. In some embodiments, a medicinal may be a composite. For example, a medicinal may include a bandage infused with antibiotics, anti-inflammatory agents, coagulants, neurotrophic agents, angiogenic agents, vitamins or pharmaceutical agents.

As depicted in FIG. 1, the substantially thermally sealed storage container 100 includes a gap 120 between the inner wall 110 and the outer wall 105. In the embodiment illustrated in FIG. 1, there are no irregularities or additions within the gap 120 to thermally join or create a thermal connection between the inner wall 110 and the outer wall 105 across the gap 120 when the container is upright, or in the position configured for normal use of the container 100. When the container 100 is in an upright position, as illustrated in FIG. 1, the inner wall 110 and the outer wall 105 do not directly come into contact with each other. Further, when the container 100 is in an upright position, there are no additions, junctions, flanges, or other fixtures within the gap that would function as a thermal connection across the gap 120 between the inner wall 110 and the outer wall 105. A substantially thermally sealed storage container 100 including a gap 120 between the exterior of the substantially thermally sealed storage container 100 and a substantially thermally sealed storage region 130 within the container 100 also includes a flexible connector 115 wherein the flexible connector 115 has sufficient flexibility to reversibly flex within the gap 120. A substantially thermally sealed storage container 100 including a gap 120 between the exterior of the substantially thermally sealed storage container 100 and a substantially thermally sealed storage region 130 within the container 100 also includes a flexible connector 115 wherein the flexible connector is configured to bear the load of the inner wall 110 without contact with the outer wall 105 when the container is in an upright position as suitable for routine use.

In some embodiments, a substantially thermally sealed storage container 100 may include one or more sections of an ultra efficient insulation material. In some embodiments, there is at least one section of ultra efficient insulation material within the gap 120. The term "ultra efficient insulation material," as used herein, may include one or more type of insulation material with extremely low heat conductance and extremely low heat radiation transfer between the surfaces of the insulation material. The ultra efficient insulation material may include, for example, one or more layers of thermally reflective film, high vacuum, aerogel, low thermal conductivity bead-like units, disordered layered crystals, low density solids, or low density foam. In some embodiments, the ultra efficient insulation material includes one or more low density solids such as aerogels, such as those described in, for example: Fricke and Emmerling, Aerogels—preparation, properties, applications, Structure and Bonding 77: 37-87 (1992); and Pekala, Organic aerogels from the polycondensation of resorcinol with formaldehyde, Journal of Materials Science 24: 3221-3227 (1989), which are each herein incorporated by reference. As used herein, "low density" may include materials with density from about 0.01 $g/cm^3$ to about 0.10 $g/cm^3$, and materials with density from about 0.005 $g/cm^3$ to about 0.05 $g/cm^3$. In some embodiments, the ultra efficient insulation material includes one or more layers of disordered layered crystals, such as those described in, for example: Chiritescu et al., Ultralow thermal conductivity in disordered, layered $WSe_2$ crystals, Science 315: 351-353 (2007), which is herein incorporated by reference. In some embodiments, the ultra efficient insulation material includes at least two layers of thermal reflective film separated, for example, by at least one of: high vacuum, low thermal conductivity spacer units, low thermal conductivity bead like units, or low density foam. In some embodiments, the ultra efficient insulation material may include at least two layers of thermal reflective material and at least one spacer unit between the layers of thermal reflective material. For example, the ultra-efficient insulation material may include at least one multiple layer insulating composite such as described in U.S. Pat. No. 6,485,805 to Smith et al., titled "Multilayer insulation composite," which is herein incorporated by reference. For example, the ultra-efficient insulation material may include at least one metallic sheet insulation system, such as that described in U.S. Pat. No. 5,915,283 to Reed et al., titled "Metallic sheet insulation system," which is herein incorporated by reference. For example, the ultra-efficient insulation material may include at least one thermal insulation system, such as that described in U.S. Pat. No. 6,967,051 to Augustynowicz et al., titled "Thermal insulation systems," which is herein incorporated by reference. For example, the ultra-efficient insulation material may include at least one rigid multilayer material for thermal insulation, such as that described in U.S. Pat. No. 7,001,656 to Maignan et al., titled "Rigid multilayer material for thermal insulation," which is herein incorporated by reference. For example, the ultra-efficient insulation material may include multilayer insulation material, or "MLI." For example, an ultra efficient insulation material may include multilayer insulation material such as that used in space program launch vehicles, including by NASA. See, e.g., Daryabeigi, "Thermal analysis and design optimization of multilayer insulation for reentry aerodynamic heating," Journal of Spacecraft and Rockets 39: 509-514 (2002), which is herein incorporated by reference. For example, the ultra efficient insulation material may include space with a partial gaseous pressure lower than atmospheric pressure external to the container 100. In some embodiments, the ultra efficient insulation material may substantially cover the inner wall 110 surface facing the gap 120. In some embodiments, the ultra efficient insulation material may substantially cover the outer wall 105 surface facing the gap 120. In some embodiments, the ultra efficient insulation material may substantially fill the gap 120.

In some embodiments, there is at least one layer of multilayer insulation material within the gap 120, wherein the at least one layer of multilayer insulation material substantially surrounds the inner wall 110. In some embodiments, there are a plurality of layers of multilayer insulation material within the gap 120, therein the layers may not be homogeneous. In some embodiments there may be one or more additional layers within or in addition to the ultra efficient insulation material, such as, for example, an outer structural layer or an inner structural layer. An inner or an outer structural layer may be made of any material appropriate to the embodiment, for example an inner or an outer structural layer may include: plastic, metal, alloy, composite, or glass. In some embodiments, there may be one or more layers of high vacuum between layers of thermal reflective film. In some embodiments, the gap 120 includes a substantially evacuated gaseous pressure relative to the atmospheric pressure external to the container 100. For example, in some embodiments the gap 120 includes substantially evacuated space having a pressure less than or equal to $1\times10^{-2}$ torr. For example, in some embodiments the gap 120 includes substantially evacuated space having a pressure less than or equal to $5\times10^{-4}$ torr. For example, in some embodiments the gap 120 includes a pressure less than or equal to $1\times10^{-2}$ torr in the gap 120. For example, in some embodiments the gap 120 includes a pressure less than or equal to $5\times10^{-4}$ torr in the gap 120. In some embodiments, the gap 120 includes a pressure less than $1\times10^{-2}$ torr, for example, less than $5\times10^{-3}$ torr, $5\times10^{-4}$ torr, $5\times10^{-5}$ torr, $5\times10^{-6}$ torr or $5\times10^{-7}$ torr. For example, in some embodiments the gap 120 includes a plurality of layers of multilayer insulation material and substantially evacuated space having a pressure less than or equal to $1\times10^{-2}$ torr. For example, in some embodiments the gap 120 includes a plurality of layers of multilayer insulation material and substantially evacuated space having a pressure less than or equal to $5\times10^{-4}$ torr.

The substantially thermally sealed storage container 100 includes a flexible connector 115 joining an aperture in an exterior of a substantially thermally sealed storage container 100 to an aperture in a substantially thermally sealed storage region 130 within the container. The container 110 includes a flexible connector 115 joining the edge of the single outer wall aperture and the edge of the single inner wall aperture. As illustrated in FIG. 1, the flexible connector 115 is configured to completely support a mass of the substantially thermally sealed storage region 130 and material stored within the substantially thermally sealed storage region 130 while the container is in an upright position. Extensometers, such as those available from MTS® (Eden Prairie, Minn.) may be used to test flexible connector designs and prototypes for suitable strength for a particular embodiment. Tension testers, such as those available from Instron® (Norwood, Mass.) may be used to test flexible connector designs and prototypes for suitable strength and/or durability for a particular embodiment. As illustrated in FIG. 8, the flexible connector 115 is configured to flex sufficiently to allow the substantially thermally sealed storage region 130 to move to the maximum distance as defined by the outer wall 105. In embodiments where there is ultra-insulation material within the gap 120, the substantially thermally sealed storage region 130 may be limited in movement by contact with the ultra-insulation material. In some embodiments, the ultra-insulation material may temporarily displace or compress to accommodate motion of the thermally sealed storage region 130. For example, ultra-insulation material with a granular structure may displace within the gap 120 to accommodate motion of the thermally sealed storage region 130. For example, layers of multilayer insulation material may compress to accommodate motion of the thermally sealed storage region 130.

A flexible connector 115 is flexible along its length, or vertically as depicted in FIG. 1. A flexible connector 115 may be flexible along its vertical axis relative to an upright position of the container. In the embodiment illustrated in FIG. 1, for example, the flexible connector 115 may shorten by up to 10% of its length for brief periods during use. For example, the flexible connector 115 may temporarily compress to 90%, 93%, 95% or 98% of its usual length during use, such as during transport or in response to physical force on the container 100. A flexible connector 115 is flexible laterally, or horizontally as depicted in FIG. 1. For example, the flexible connector 115 depicted in FIG. 1 may bend or flex in a lateral direction, or approximately horizontally as shown in FIG. 1. In the embodiment illustrated in FIG. 1, for example, the flexible connector 115 may bend by up to 30 degrees relative to a central axis of the conduit 125 for brief periods during use. For example, the flexible connector 115 may temporarily flex by 5 degrees, 10 degrees, 15 degrees, 20 degrees, 25 degrees or 30 degrees from a linear vertical central axis of the conduit 125 during use, such as if the container 100 is placed in a horizontal position (i.e. on its side). In some embodiments, the flexible connector 115 has the capacity to reversibly flex to the degree required for the inner wall 110 to be positioned adjacent to the outer wall 105. See also FIGS. 8 and 9 as well as the accompanying text.

The flexible connector 115 includes a duct forming an elongated thermal pathway 160 between the exterior of the container 100 and the substantially thermally sealed storage region 130, the duct substantially defining a conduit 125 between the exterior of the substantially thermally sealed storage container 100 and the aperture to the substantially thermally sealed storage region 130. The flexible connector 115 includes a first compression unit 150 configured to mate with a first end of the duct, a second compression unit 140 configured to mate with a second end of the duct, and a plurality of compression strands 145 connected between the first compression unit 150 and the second compression unit 140. In some embodiments, the first compression unit 150 substantially encircles the first end of the duct. In some embodiments, the second compression unit 140 substantially encircles the second end of the duct. As illustrated in FIG. 1, only a single one of the plurality of compression strands 145 is visible, but further views of the plurality of compression strands 145 are evident in later figures. In some embodiments, the plurality of compression strands 145 include at least six compression strands positioned at approximately equal intervals around the circumference of the duct. The duct includes a region forming an extended thermal pathway 160. The duct includes a first flange region and a second flange region, as illustrated in the following figures.

The flexible connector 115 may be fabricated from a variety of materials, depending on the embodiment. For example, the flexible connector 115 may be fabricated from materials with particular densities, strength, resilience or thermal conduction properties as appropriate to the embodiment. In some embodiments, the flexible connector 115 is fabricated from stainless steel. In some embodiments, the flexible connector 115 is fabricated from plastics. In some embodiments, the duct is fabricated from stainless steel. In some embodiments, the first compression unit is fabricated from stainless steel. In some embodiments, the second compression unit is fabricated from stainless steel. In some embodiments, the plurality of compression strands are fabricated from stainless steel.

Depending on the embodiment, a substantially thermally sealed storage container 100 may be fabricated from a variety of materials. For example, a substantially thermally sealed storage container 100 may be fabricated from metals, fiberglass or plastics of suitable characteristics for a given embodiment. For example, a substantially thermally sealed storage container 100 may include materials of a suitable strength, hardness, durability, cost, availability, thermal conduction characteristics, gas-emitting properties, or other considerations appropriate for a given embodiment. In some embodiments, the outer wall 105 is fabricated from stainless steel. In some embodiments, the outer wall 105 is fabricated from aluminum. In some embodiments, the inner wall 110 is fabricated from stainless steel. In some embodiments, the inner wall 110 is fabricated from aluminum. In some embodiments, the flexible connector 115 is fabricated from stainless steel. In some embodiments, portions or parts of a substantially thermally sealed storage container 100 may be fabricated from composite or layered materials. For example, an outer wall 105 may be substantially be fabricated from stainless steel, with an external covering of plastic. For example, an inner wall 110 may substantially be fabricated from stainless steel, with a coating within the substantially sealed storage region 130 of plastic, rubber, foam or other material suitable to provide support and insulation to material stored within the substantially sealed storage region 130.

In embodiments with an inner wall 110 and/or an outer wall 105 fabricated from one or more materials and a flexible connector 115 fabricated from one or more different materials, one or more junction units 155, 135 may be included in the substantially thermally sealed storage container 100 to ensure a suitably strong, durable and/or gas-impermeable connection between the inner wall 110 and the flexible connector 115 and/or the outer wall 105 and the flexible connector 115. A "junction unit," as used herein, includes a unit configured for connections to two different components of the container 100, forming a junction between the different components. A substantially thermally sealed container 100 may include a gas-impermeable junction between the first end of the duct and the outer wall at the edge of the outer wall aperture. A substantially thermally sealed container 100 may include a gas-impermeable junction between the second end of the duct and the inner wall at the edge of the inner wall aperture. Some embodiments include a gas-impermeable junction between the second end of the duct and the substantially thermally sealed storage region 130, the gas-impermeable junction substantially encircling the aperture in the substantially thermally sealed storage region 130. For example, in embodiments with a inner wall 110 and/or an outer wall 105 fabricated from aluminum and a flexible connector 115 fabricated from stainless steel, one or more junction units 155, 135 may be included in the substantially thermally sealed storage container 100 to ensure a suitably strong and gas-impermeable attachment between the inner wall 110 and the flexible connector 115 and/or the outer wall 105 and the flexible connector 115. Some embodiments include a gas-impermeable junction between the first end of the duct and the exterior of the substantially thermally sealed storage container 100, the gas-impermeable junction substantially encircling the aperture in the exterior. For example, as depicted in FIG. 1, a substantially ring-shaped junction unit 155 is illustrated to functionally connect the top edge of the flexible connector 115 and the edge of the aperture in the outer wall 105. For example, as depicted in FIG. 1, a substantially ring-shaped junction unit 135 is illustrated between the bottom edge of the flexible connector 115 and the edge of the aperture in the inner wall 110. Junction units such as those depicted 155, 135 in FIG. 1 may be fabricated from roll bonded clad metals, for example as roll bonded transition inserts such as those available from Spur Industries Inc., (Spokane Wash.). For example, a roll bonded transition insert including a layer of stainless steel bonded to a layer of aluminum is a suitable base for fabricating a junction unit 155, 135 between an aluminum outer wall 105 or inner wall 110 and a stainless steel flexible connector 115. In such an embodiment, a junction unit 155, 135 is positioned so that identical materials are placed adjacent to each other, and then operably sealed together using commonly implemented methods, such as welding. For example, in an embodiment where a container 100 includes an aluminum outer wall 105 and a stainless steel flexible connector 115, a roll bonded transition insert including a layer of stainless steel bonded to a layer of aluminum may be used in a first junction unit 155, suitably positioned so that the aluminum outer wall 105 may be welded to the aluminum portion of the first junction unit 155. Similarly, the stainless steel portion of the junction unit 155 may be welded to the top edge of the stainless steel flexible connector 115. A second junction unit 135 may be similarly used to operably attach the bottom edge of the stainless steel flexible connector 115 to the edge of the aperture in the aluminum inner wall 110. In embodiments where junction units 135, 155 are not utilized, brazing methods and suitable filler materials may be used to operably attach a flexible connector 115 fabricated from materials distinct from the materials used to fabricate the outer wall 105 and/or the inner wall 110.

FIG. 1 illustrates a substantially thermally sealed container 100 including an outer wall 105 and an inner wall 110, with a flexible connector 115 between the outer wall 105 and the inner wall 110. As shown in FIG. 1, the inner wall 110 roughly defines a substantially thermally sealed storage region 130. When the container 100 is in an upright position, as depicted in FIG. 1, the flexible connector 115 is configured to entirely support the mass of the inner wall 110 and the total contents of the substantially thermally sealed storage region 130. In addition, in embodiments wherein a gap 120 includes a gaseous pressure less than atmospheric pressure (e.g. less than or equal to $1\times10^{-2}$ torr, or less than or equal to $5\times10^{-4}$ torr), the flexible connector 115 as depicted in FIG. 1 supports the mass of the inner wall 110 and any contents of the substantially thermally sealed storage region 130 against the force of the partial pressure within the gap 120. For example, in an embodiment wherein the flexible connector 115 includes a conduit 125 of approximately 2½ inches in diameter and the partial pressure of the gap 120 is $5\times10^{-4}$ torr, the downward force on the region of the inner wall 110 directly opposite to the end of the conduit 125 is approximately equivalent to 100 pounds of weight at that location due to the partial pressure in the gap 120. As illustrated in FIG. 1, when the container 100 is in an upright position, the flexible connector 115 substantially supports the mass of the inner wall 110 and any contents of the substantially thermally sealed storage region 130 without additional supporting elements within the gap 120. For example, in the embodiment illustrated in FIG. 1, the inner wall 110 is connected to the flexible connector 115, and the inner wall 110 does not contact any other supporting units when the container 100 is in an upright position. As illustrated in FIG. 1, in embodiments wherein an inner wall 110 is entirely freely supported by the flexible connector 115, the inner wall may swing or otherwise move within the gap 120 in response to motion of the container 100. For example, when the container 100 is transported, the flexible connector 115 may bend or flex in response to the transportation motion, and the inner wall 110 may correspondingly swing or move within the gap 120. See also FIGS. 8 and 9, and associated text.

In some embodiments, additional supporting units may be included in the gap 120 to provide additional support to the inner wall 110 in addition to that provided by the flexible connector 115. For example, there may be one or more thermally non-conductive strands attached to the surface of the outer wall 105 facing the gap 120, wherein the thermally non-conductive strands are configured to extend around the surface of the inner wall 110 facing the gap 120 and provide additional support or movement restraint on the inner wall 110 and, by extension, the contents of the substantially thermally sealed storage region 130. In some embodiments, the central regions of the plurality of strands wrap around the inner wall 110 at diverse angles, with the corresponding ends of each of the plurality of strands fixed to the surface of the outer wall 105 facing the gap 120 at multiple locations. One or more thermally non-conductive strands may be, for example, fabricated from fiberglass strands or ropes. One or more thermally non-conductive strands may be, for example, fabricated from stainless steel strands or ropes. One or more thermally non-conductive strands may be, for example, fabricated from strands of a para-aramid synthetic fiber, such as Kevlar™. A plurality of thermally non-conductive strands may be attached to the surface of the outer wall 105 facing the gap 120 at both ends, with the center of the strands wrapped around the surface of the inner wall 110 facing the gap 120. For example, a plurality of strands fabricated from stainless steel ropes may be attached to the surface of the outer wall 105 facing the gap 120 at both ends, with the center of the strands wrapped around the surface of the inner wall 110 facing the gap 120.

Figure 2:
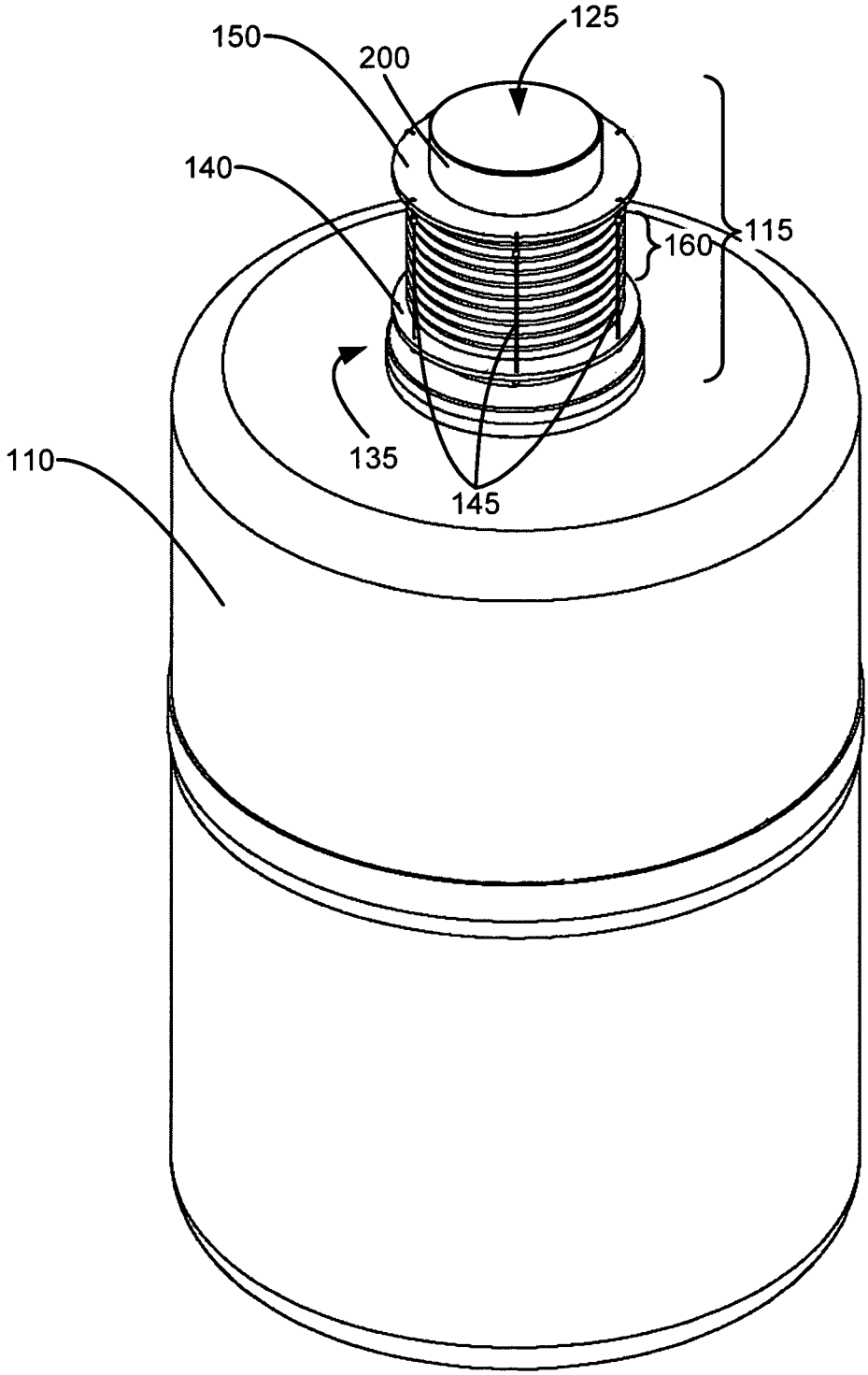
FIG. 2 depicts a flexible connector joined to the inner wall of a substantially thermally sealed storage container.

FIG. 2 illustrates additional aspects of some embodiments of a substantially thermally sealed container 100. For purposes of illustration, FIG. 2 depicts an inner wall 110 in conjunction with a flexible connector 115. A junction unit 135 operably connects the inner wall 110 to the flexible connector 115. For example, in embodiments where the inner wall 110 is fabricated from aluminum and the flexible connector 115 is fabricated from stainless steel, a junction unit 135 configured to provide a stable and durable junction between the inner wall 110 and the flexible connector 115 may be included in the container 100. A conduit 125 is formed by the interior surface of the flexible connector 115. The flexible connector 115 includes a duct with a first edge region 200. The duct first edge region 200 on the end of the flexible connector 115 facing the outer wall 105 (not shown in FIG. 2) may be, in a complete container 100 (not shown in FIG. 2), operably connected to the edge of an aperture in the outer wall 105. The flexible connector 115 includes a duct region forming an elongated thermal pathway 160, and a first compression unit 150 and a second compression unit 140 substantially encircling the first and second end region, respectively, of the duct region forming an elongated thermal pathway 160. A plurality of compression strands 145 operably connect the first compression unit 150 and the second compression unit 140. As is evident from FIG. 2, the plurality of compression strands 145 substantially encircle and connect the disk-like structures of the first compression unit 150 and the second compression unit 140. The plurality of compression strands 145 substantially define a maximum distance between the first compression unit 150 and the second compression unit 140.

Figure 3:
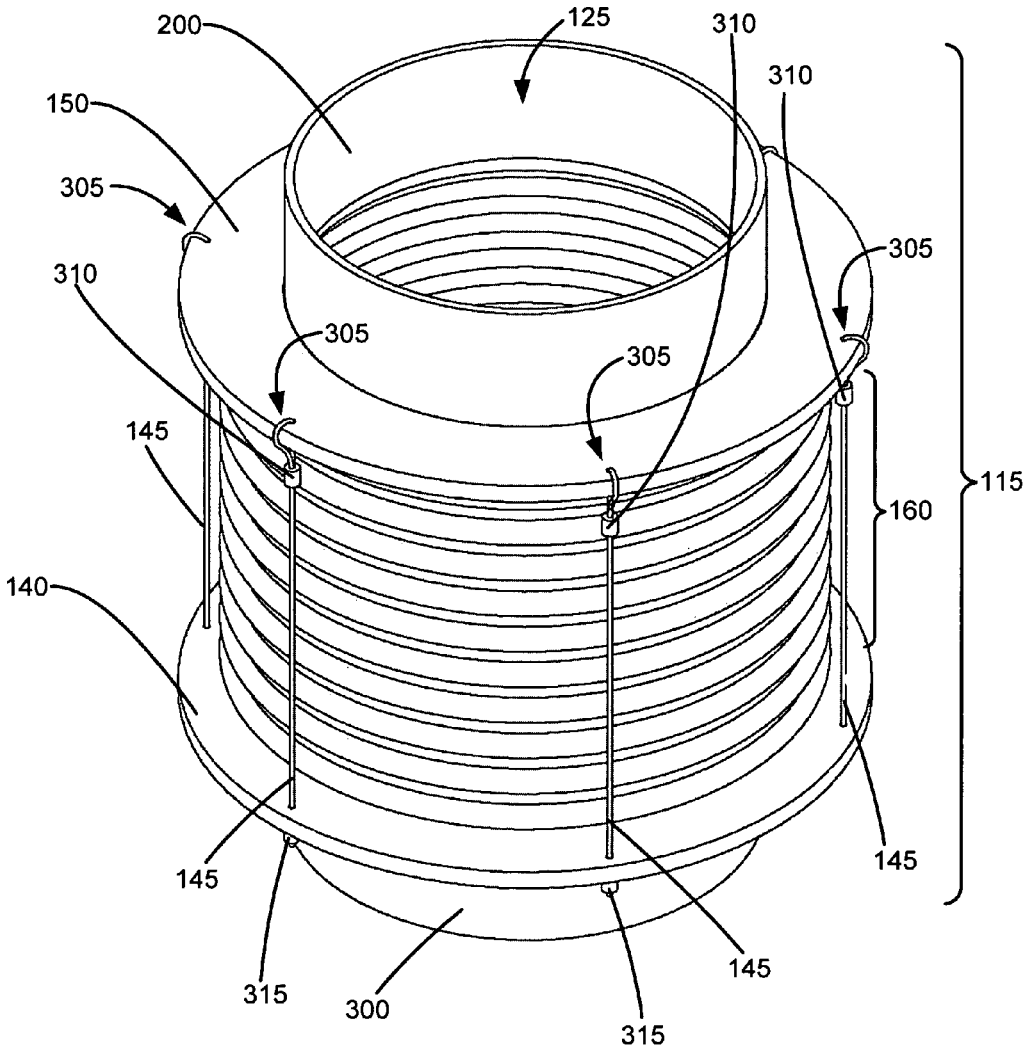
FIG. 3 shows aspects of a flexible connector.

FIG. 3 illustrates a flexible connector 115 in isolation from a container 100. The flexible connector 115 includes a duct with a region forming an extended thermal pathway 160. The duct includes a region forming an extended thermal pathway 160 as well as a first edge region 200 and a second edge region 300. A conduit 125 is formed by the interior surface of the duct. As shown in FIG. 3, the duct with a region forming an extended thermal pathway 160 includes a plurality of corrugated folds positioned at right angles to a central axis of the conduit 125. The duct includes a first edge region 200 and a second edge region 300. The flexible connector 115 includes a first compression unit 150 and a second compression unit 140. The first compression unit 150 substantially encircles the first end of the duct. The second compression unit 140 substantially encircles the second end of the duct. A plurality of compression strands 145 are connected between the first compression unit 150 and the second compression unit 140. As shown in FIG. 3, some embodiments include at least six compression strands 145 positioned at approximately equal intervals around the circumference of the duct. The compression strands 145 define a maximum distance between the first compression unit 150 and the second compression unit 140. In the embodiment illustrated in FIG. 3, the first ends of the compression strands 145 are operably fixed to the first compression unit 150 by loops 305 formed by the compression strands 145 threaded through apertures in the first compression unit 150 and around the edge of the first compression unit 150. The compression strands 145 are fixed in the loop configuration by the ends of the compression strands 145 by crimp units 310. The second ends of the compression strands 145 are operably fixed relative to the second compression unit 140 by being threaded through apertures in the second compression unit 140 and the distal ends of the second ends of the compression strands 145 fixed in place with crimp units 315. In some embodiments, the compression strands may be tied, glued, welded or otherwise fixed in place to form a defined maximum separation between the first compression unit 150 and the second compression unit 140. In the configuration depicted in FIG. 3, the space between the first compression unit 150 and the second compression unit 140, as defined by the lengths of the compression strands, establish the maximum size of the region of the duct forming an extended thermal pathway 160.

Figure 4:
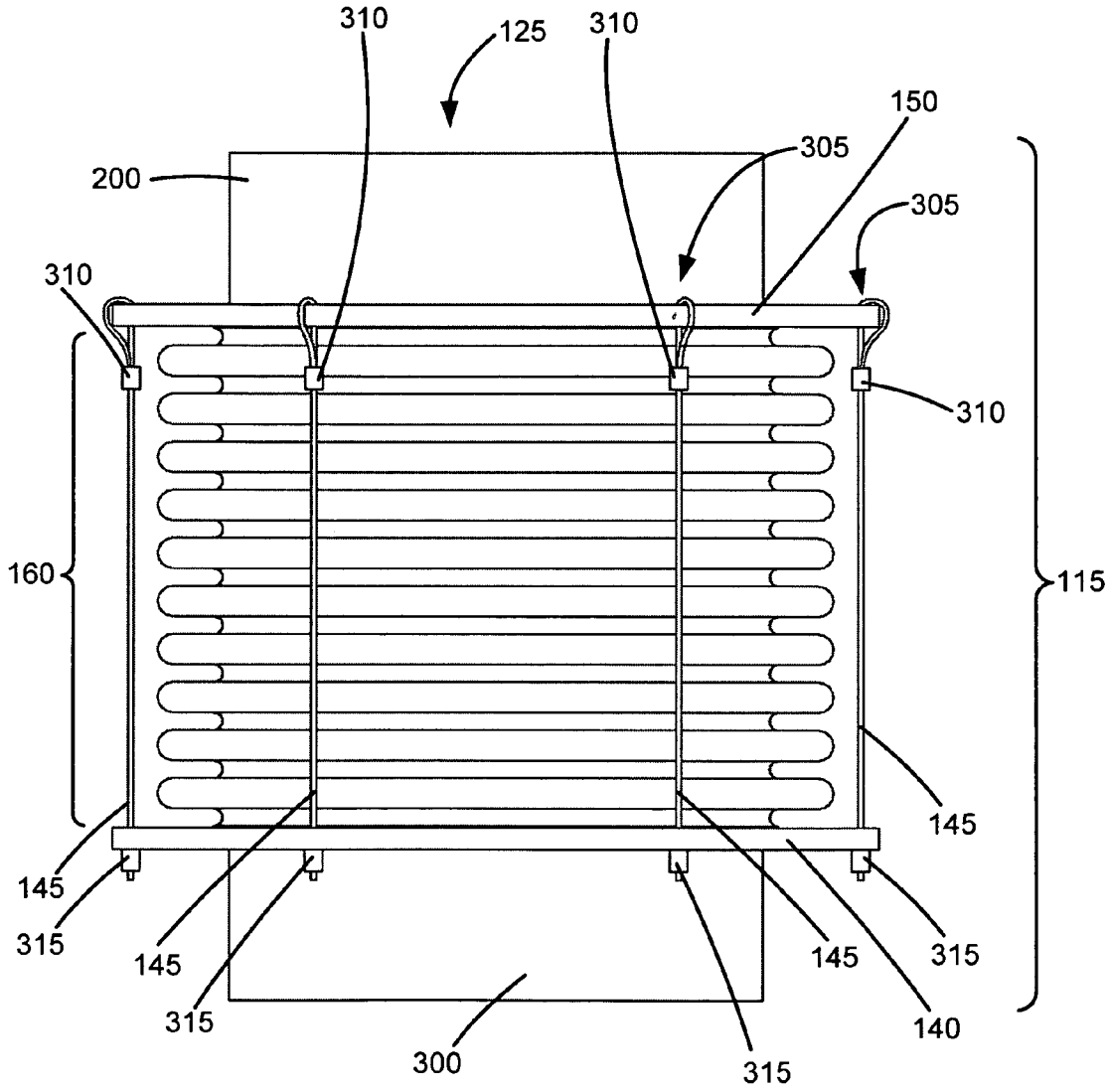
FIG. 4 illustrates an external side view of the flexible connector depicted in FIG. 3.

FIG. 4 illustrates a horizontal view of a flexible connector 115, such as that depicted in FIG. 3. The flexible connector 115 includes a duct including a region forming an extended thermal pathway 160 as well as a first edge region 200 and a second edge region 300. In an embodiment such as that illustrated in FIG. 1, the first edge region 200 would be operably attached to the edge of an aperture in the outer wall 105 of the container 110, and the second edge region 300 would be operably attached to the edge of an aperture in the inner wall 110. A conduit 125 is formed by the interior surface of the duct, which is interior to the view depicted in FIG. 4. As illustrated in FIG. 4, a central axis of the conduit 125 formed by the interior surface of the duct would be approximately vertical. As illustrated in FIG. 4, a central axis of the conduit 125 formed by the interior surface of the duct would be approximately perpendicular to the first compression unit 150 and the second compression unit 140. As illustrated in FIG. 4, a central axis of the conduit 125 formed by the interior surface of the duct would be approximately parallel with the compression strands 145. As illustrated in FIG. 4, the region forming an extended thermal pathway 160 may include a plurality of corrugated folds positioned at right angles to a central axis of the conduit. In some embodiments, the region forming an extended thermal pathway 160 may include a plurality of concavities positioned at right angles to a central axis of the conduit 125, the plurality of concavities forming an extended thermal pathway between the inner wall 110 and the outer wall 105. In some embodiments, the region forming an extended thermal pathway 160 may include an elongated region of the duct.

FIG. 4 depicts a flexible connector 115 including a first compression unit 150 and a second compression unit 140. The first compression unit 150 may substantially encircle the duct between the first edge region 200 and the region forming an extended thermal pathway 160. As illustrated in FIG. 4, the first compression unit 150 may be fabricated to contact an edge of the region forming an extended thermal pathway 160. A surface of the first compression unit 150 may be of a size and shape configured to be adjacent to an edge of the region forming an extended thermal pathway 160. Similarly, the second compression unit 140 may substantially encircle the duct between the second edge region 300 and the region forming an extended thermal pathway 160. The second compression unit 140 may be fabricated to contact the edge of the region forming an extended thermal pathway 160 at a position distal to the first compression unit. A surface of the second compression unit 140 may be of a size and shape configured to be adjacent to the edge of the region forming an extended thermal pathway 160. The first compression unit 150 and the second compression unit 140 are connected and oriented relative to each other on opposite ends of the region forming an extended thermal pathway 160 by a plurality of compression strands 145. The plurality of compression strands 145 may include at least six compression strands positioned at approximately equal intervals around the circumference of the duct. The plurality of compression strands 145 may include at least six compression strands positioned at approximately equal intervals relative to the outer edges of the first compression unit 150 and the second compression unit 140. As illustrated in FIG. 4, in some embodiments a plurality of compression strands 145 are of approximately equal length. As illustrated in FIG. 4, in some embodiments the compression strands 145 are fabricated from substantially equivalent materials. As illustrated in FIG. 4, the compression strands 145 may be fixed in position relative to the first compression unit 150 with end regions of the compression strands 145 forming loops 305 through apertures in the first compression unit 150 and around the outer rim of the first compression unit 150. For example, the loops 305 may be fixed in position with crimp units 310. As illustrated in FIG. 4, the compression strands 145 may be fixed in position relative to the second compression unit 140 with end regions of the compression strands 145 positioned through apertures in the second compression unit 140 and stabilized. For example, the end regions of the compression strands 145 may be fixed in position relative to the second compression unit 140 with crimp units 315.

As illustrated in FIG. 4, in embodiments where the compression strands 145 are fixed at approximately equal lengths relative to the first compression unit 150 and the second compression unit 140, the maximum distance between the first compression unit 150 and the second compression unit 140 is substantially identical around the surfaces of the compression units 140, 150. As the respective end regions of the compression strands 145 are fixed in position relative to the first compression unit 150 and the second compression unit 140, the maximum distance between the first compression unit 150 and the second compression unit 140 is set relative to the length of the compression strands 145 between the first compression unit 150 and the second compression unit 140. However, as depicted in FIG. 4, the flexible connector 115 may be configured to allow compression of the duct region forming an extended thermal pathway 160. The flexible connector 115 may be configured to allow the region forming an extended thermal pathway 160 to shorten through compacting the region forming an extended thermal pathway 160. For example, in the embodiment shown in FIG. 4, the corrugated folds in the region forming an extended thermal pathway 160 may bend or flex to shorten the total length of the region forming an extended thermal pathway 160. The bending or flexing of the region forming an extended thermal pathway 160 may be balanced across the region forming an extended thermal pathway 160, retaining the first compression unit 150 and the second compression unit 140 in a substantially parallel position. The bending or flexing of the region forming an extended thermal pathway 160 may be uneven across the region forming an extended thermal pathway 160, thereby moving the first compression unit 150 and the second compression unit 140 away from a substantially parallel position.

Figure 5:
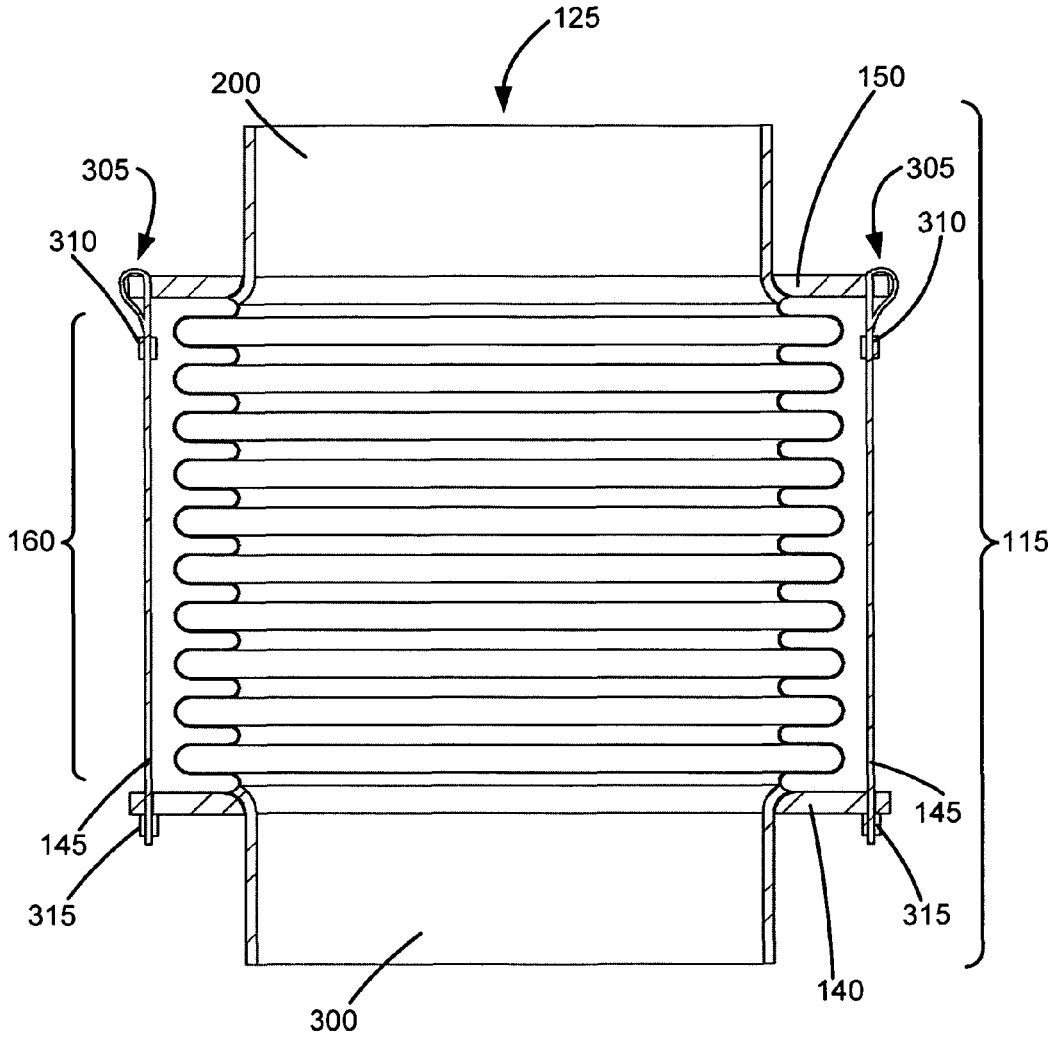
FIG. 5 depicts a cross-section view of the flexible connector depicted in FIG. 3.

FIG. 5 illustrates a cross-section view of the flexible connector 115 depicted in FIG. 4. The flexible connector 115 includes a duct with a region forming an extended thermal pathway 160, a first end region 200 and a second end region 300. The interior region of the duct forms a conduit 125. A first compression unit 150 is configured to substantially encircle the duct at a location between the region forming an extended thermal pathway 160 and a first end region 200. A second compression unit 140 is configured to substantially encircle the duct at a location between the region forming an extended thermal pathway 160 and a second end region 300. The surfaces of the first compression unit 150 and the second compression unit 140 are configured to mate with the surface of the duct at their respective ends. The surfaces of the first compression unit 150 and the second compression unit 140 are configured to transfer force on the respective ends of the duct region forming an extended thermal pathway 160. A illustrated in FIG. 5, the first compression unit 150 and the second compression unit 140 are connected through a plurality of compression strands 145. The end regions of the compression strands 145 may be fixed relative to the first compression unit 150 and the second compression unit 140. For example, the end regions of the compression strands 145 may pass through apertures in the first compression unit 150 and the second compression unit 140 and be fixed with crimp units 310, 315 relative to the apertures in the compression units 150, 140. For example, the end regions of the compression strands 145 may pass through apertures in the first compression unit 150 and form a loop structure 305 relative to the outer edge of the first compression unit 150. The end regions of the compression strands 145 may be fixed relative to the first compression unit 150 and the second compression unit 140 and thereby limit the maximum distance between the first compression unit 150 and the second compression unit 140. The end regions of the compression strands 145 may be fixed at equivalent lengths relative to the first compression unit 150 and the second compression unit 140 and thereby position the first compression unit 150 and the second compression unit 140 in a substantially parallel orientation.

Figure 6:
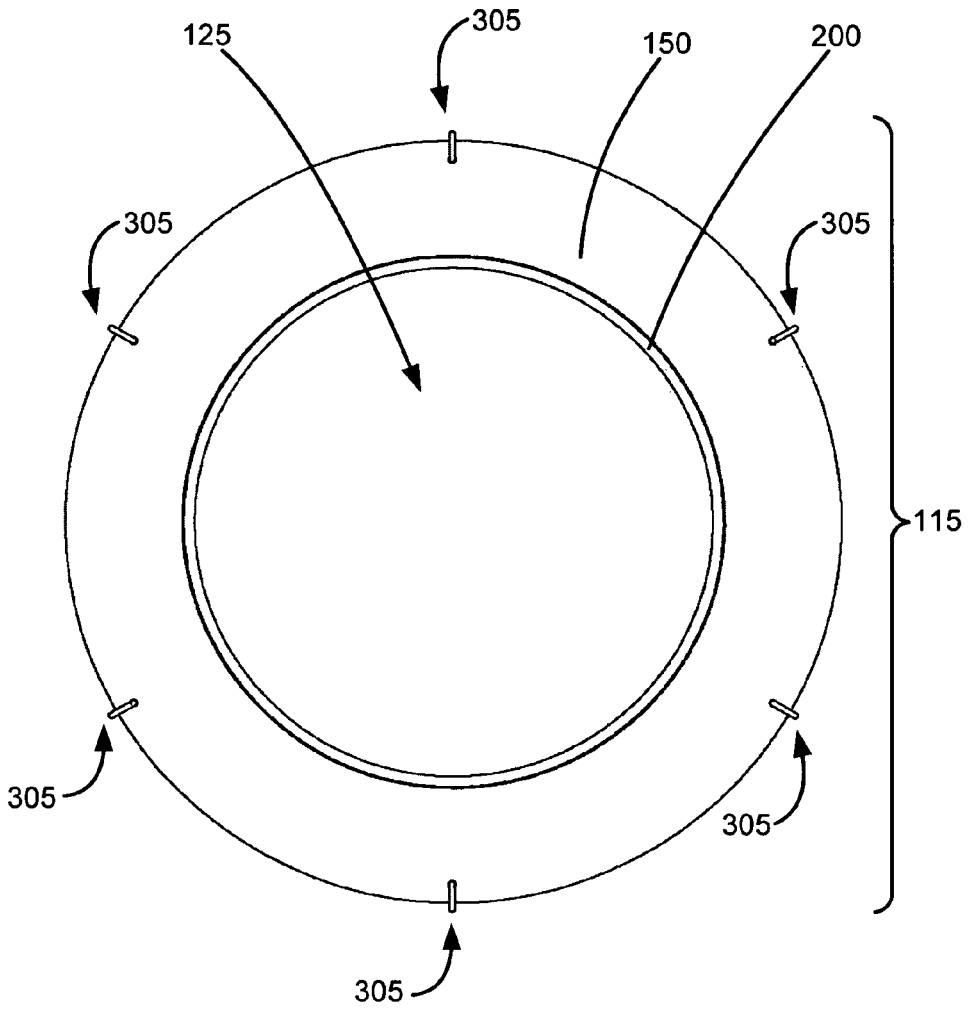
FIG. 6 shows a view downwards from the top of the flexible connector depicted in FIG. 3.

FIG. 6 depicts a "top-down" view of an embodiment of a flexible connector 115. For example, the view of an embodiment of a flexible connector 115 as illustrated in FIG. 6 is a view relative to the flexible connector 115 illustrated in FIG. 5 from the top and looking downward. As shown in FIG. 6, a flexible connector 115 includes a first compression unit 150. The first compression unit 150 substantially encircles the outer surface of the first end region 200 of a duct. The center of the duct forms a conduit 125. Six compression strands pass through apertures positioned at roughly equal intervals around the outer edge of the first compression unit 150 and form loops 305 around the outer rim of the first compression unit 150. Although the first compression unit 150 illustrated in FIG. 6 is a circular or ring-like structure, other configurations are possible in different embodiments. For example, a first compression unit 150 may be oval, square, or of another shape as appropriate to a specific embodiment.

Figure 7:
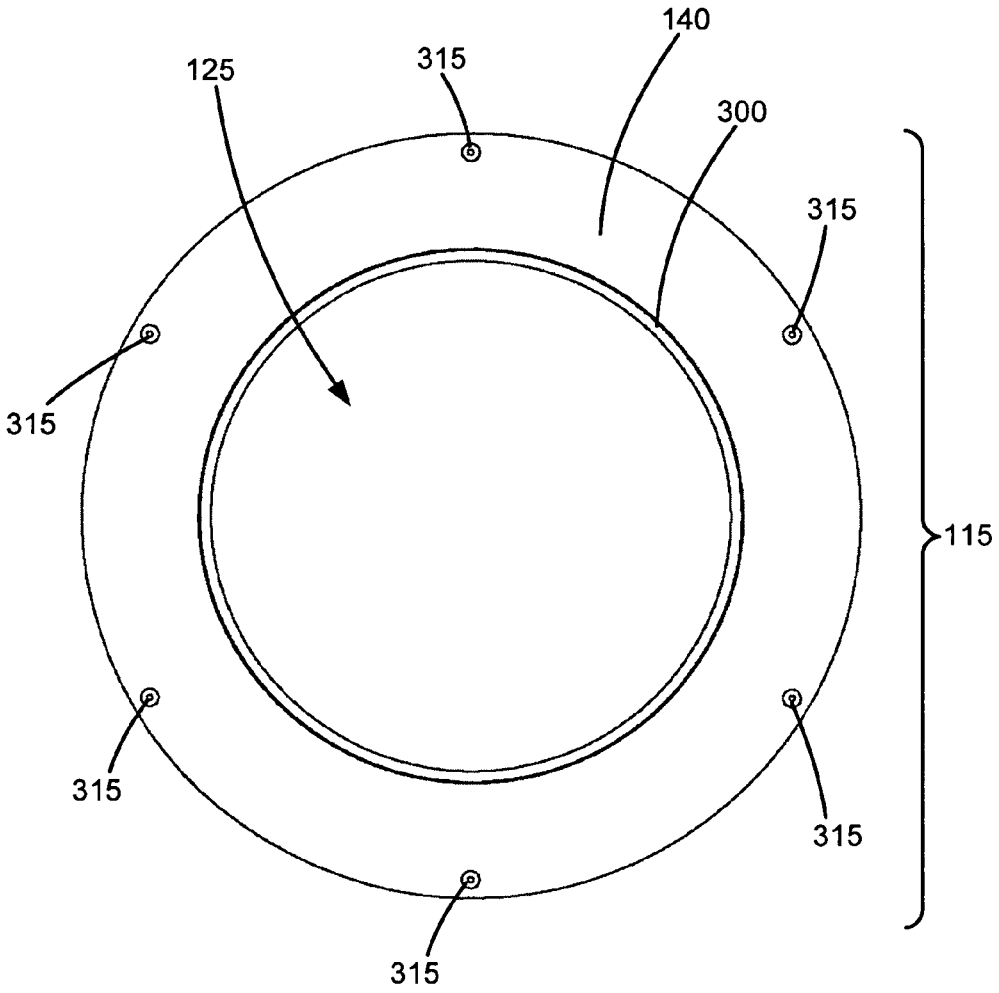
FIG. 7 illustrates a view upwards from the bottom of the flexible connector depicted in FIG. 3.

FIG. 7 illustrates a "bottom-up" view of an embodiment of a flexible connector 115. For example, the view of an embodiment of a flexible connector 115 as illustrated in FIG. 7 is a view relative to the bottom of the flexible connector depicted in FIG. 5 looking upward. As illustrated in FIG. 7, a flexible connector 115 includes a second compression unit 140. The second compression unit 140 substantially encircles the outer surface of the second end region 300 of a duct. The center of the duct forms a conduit 125. Six compression strands pass through apertures positioned at roughly equal intervals around the outer edge of the second compression unit 140 and are fixed with crimp units 315 relative to the outer rim of the second compression unit 140. Although the second compression unit 140 illustrated in FIG. 6 is a circular or ring-like structure, other configurations are possible in different embodiments. For example, a second compression unit 140 may be oval, square, or of another shape as appropriate to a specific embodiment.

FIG. 8 depicts aspects of a substantially thermally sealed container 100 such as those described herein, including an outer wall 105 and an inner wall 110, with a flexible connector 115 operably connecting the outer wall 105 to the inner wall 110. The interior of the flexible connector 115 forms a conduit 125 between a region exterior to the container 100 and a substantially thermally sealed storage region 130 within the container 100. The container 100 depicted in FIG. 8 is configured to be positioned in a substantially upright position, i.e. with the conduit 125 positioned roughly vertically, during regular use. FIG. 8 illustrates a cross-section view of aspects of a container 100 in a position on its side, or roughly perpendicular to an upright position of the container. Such positioning may occur, for example, by accident during transport or movement of the container 100. As illustrated in FIG. 8, when the container is positioned on its side, the flexible connector 115 allows sufficient movement for the inner wall 110 to contact the outer wall 105 at two different contact points 800, 810. Although FIG. 8 illustrates two different contact points 800, 810, depending on the embodiment there may be different numbers or positions of contact points 800, 810 when the inner wall 110 is in contact with the outer wall 105. For example, the contact points 800, 810 are formed relative to the size, shape and positioning of the outer wall 105 and the inner wall 110. In an embodiment such as that depicted in FIG. 8, the maximum bend of the flexible connector 115 should be no less than that necessary for the for the inner wall 110 to contact the outer wall 105 at the contact points 800, 810. In some embodiments, the container is positioned on its side, the flexible connector 115 allows sufficient movement for the inner wall 110 to be adjacent the outer wall 105 without direct contact between the inner wall 110 and the outer wall 105. For example, the gap 120 may include insulation material, such as multilayer insulation material, that prevents the direct contact of the inner wall 110 and the outer wall 105.

The flexible connector 115 is fabricated with sufficient flexibility, both in its horizontal and vertical directions, to allow the inner wall 110 to be positioned adjacent to the outer wall 105 at one or more contact points 800, 810. The flexible connector 115 is fabricated with sufficient flexibility, both in its horizontal and vertical directions, to allow the inner wall 110 to move to a position adjacent to the outer wall 105 while maintaining the structural integrity of the junctions between the flexible connector 115 and the outer wall 105 as well as the inner wall 110. The structural integrity of the junctions between the flexible connector 115 and the outer wall 105 and the inner wall 110 should be maintained to the degree required to maintain the thermal capabilities of the container 100 when it is realigned to an upright position. For example, in embodiments wherein the gap 120 between the outer wall 105 and the inner wall 110 contains substantially evacuated space, the junctions between the flexible connector 115 and the outer wall 105 and the inner wall 110 should be maintained as required to maintain the substantially evacuated space. For example, in embodiments wherein the gap 120 between the outer wall 105 and the inner wall 110 contains material with thermal properties that are dependent on anhydrous conditions, the junctions between the flexible connector 115 and the outer wall 105 and the inner wall 105 should be maintained as required to maintain anhydrous conditions within the gap 120. The flexible connector 115 is fabricated with sufficient flexibility, both in its horizontal and vertical directions, to allow the flexible connector to resume its usual position when the container 100 is placed in an upright position (e.g. as in FIG. 1) after being placed at an angle (e.g. as in FIG. 8) while maintaining the junctions between the flexible connector 115 and the outer wall 105 as well as the inner wall 110.

FIG. 9 illustrates aspects of a substantially thermally sealed container 100. FIG. 9 depicts a substantially thermally sealed container 100 oriented so that the aperture in the outer wall 105 is located at the top of the container 100. The container 100 illustrated in FIG. 9 is in a substantially upright, or vertical, position. As illustrated in FIG. 9, the flexible connector 115 maintains the inner wall 110 in position without contact between the inner wall 110 and the outer wall 105. A gap 120 is maintained surrounding the inner wall 110 and within the outer wall 105 by the support provided by the flexible connector 115 to the inner wall 110. The gap 120 is maintained by the support provided by the flexible connector 115 to the inner wall 110 even when the substantially thermally sealed storage region 130 includes stored material. As illustrated in FIG. 9, a substantially thermally sealed storage container 100 may include a gap 120 between the exterior of the substantially thermally sealed storage container 100 and a substantially thermally sealed storage region 130 within the container 100, and one or more restraining units 930, 900, 910 located within the gap 120.

FIG. 9 depicts a plurality of restriction units 930, 900, 910 positioned within the gap 120. The restriction units 930, 900, 910 are positioned to maintain a gap space, such as depicted as 940, 920, between the inner wall 110 and the outer wall 105. The restriction units 930, 900, 910 may be positioned to provide additional support to the inner wall 110 and the contents of the substantially thermally sealed storage region 130 when the container 100 is moved, subjected to physical shocks, or placed in a substantially vertical position (e.g. as depicted in FIG. 8). The restriction units 930, 900, 910 may be positioned to restrict the movement of the inner wall 110 within the gap 120, and therefore to restrict the maximum bendability or flexibility required for the flexible connector 115 in a given embodiment. The restriction units 930, 900, 910 may be positioned to restrict the movement of the inner wall 110 within the gap 120, and to assist the flexible connector 115 to support the inner wall 110 when the container 100 is not in an upright position. As illustrated in FIG. 9, in some embodiments a restriction unit 930 may be formed as a tab, spike, rod or similar form to restrict movement of the inner wall 110 in a set direction within the gap 120. A restriction unit 930 includes an adjacent gap 940 when the container is in a substantially upright position as depicted in FIG. 9. However, when the inner wall 110 is moved relative to the outer wall 105, the restriction unit 930 is configured to minimize the adjacent gap 940. When the inner wall 110 is moved relative to the outer wall 105, the restriction unit 930 may come into physical contact with the inner wall 110. When the inner wall 110 is moved relative to the outer wall 105, the restriction unit 930 is configured to contact the inner wall 110 and limit the total motion of the inner wall 110 as well as the associated flex or bend in the flexible connector 115. In some embodiments, a restriction unit 900, 910 may include a central rod unit 900 and an associated restriction component 910. As illustrated in FIG. 9, a central rod unit 900 with a circular top positioned at right angles to a shaft is depicted in cross-section. The central rod unit 900 is surrounded by an associated restriction component 910, which surrounds the central rod unit 900 while maintaining an adjacent gap 920 between the central rod unit 900 and the associated restriction component 910 while the container 100 is in a substantially upright position (e.g. as in FIG. 9). However, when the inner wall 110 moves relative to the outer wall 105, the central rod unit 900 is configured to come into contact with the associated restriction component 910 and limit the degree of movement of the inner wall 110 relative to the outer wall 105.

The restriction units 930, 900, 910 may be fabricated from a material of suitable strength, resilience and durability for a given embodiment, such as rubber, plastics, metals, or other materials. The restriction units 930, 900, 910 may be fabricated from materials with low thermal conduction properties so as to provide minimal thermal conduction between the inner wall 110 and the outer wall 105 when the inner wall 110 is positioned adjacent to one or more restriction units 930, 900, 910. In some embodiments, one or more restriction units 930, 900, 910 may be fabricated from a composite material, or a layer of materials, such as stainless steel overlaid with a softer plastic layer.

Some embodiments may include a substantially thermally sealed storage container including one or more temperature indicators. For example, at least one temperature indicator may be located within a substantially thermally sealed storage region, at least one temperature indicator may be located exterior to the container, or at least one temperature indicator may be located within the structure of the container. In some embodiments, multiple temperature indicators may be located in multiple positions. Temperature indicators may include temperature indicating labels, which may be reversible or irreversible. See, for example, the Environmental Indicators sold by ShockWatch Company, with headquarters in Dallas Tex., the Temperature Indicators sold by Cole-Palmer Company of Vernon Hills Ill. and the Time Temperature Indicators sold by 3M Company, with corporate headquarters in St. Paul Minn., the brochures for which are each hereby incorporated by reference. Temperature indicators may include time-temperature indicators, such as those described in U.S. Pat. Nos. 5,709,472 and 6,042,264 to Prusik et al., titled "Time-temperature indicator device and method of manufacture" and U.S. Pat. No. 4,057,029 to Seiter, titled "Time-temperature indicator," which are each herein incorporated by reference. Temperature indicators may include, for example, chemically-based indicators, temperature gauges, thermometers, bimetallic strips, or thermocouples. See also the World Health Organization (WHO) document titled "Getting Started with Vaccine Vial Monitors; Vaccines and Biologicals" dated December 2002 and the WHO document titled "Getting Started with Vaccine Vial Monitors—Questions and Answers on Field Operations," Technical Session on Vaccine Vial Monitors, Mar. 27, 2002, Geneva, which are herein incorporated by reference.

In some embodiments, a substantially thermally sealed container may include one or more sensors operably attached to the container. At least one sensor may be located within at least one substantially thermally sealed storage region, at least one sensor may be located exterior to the container, or at least one sensor may be located within the structure of the container. In some embodiments, multiple sensors may be located in multiple positions. In some embodiments, the one or more sensors includes at least one sensor of a gaseous pressure within one or more of the at least one storage region, sensor of a mass within one or more of the at least one storage region, sensor of a stored volume within one or more of the at least one storage region, sensor of a temperature within one or more of the at least one storage region, or sensor of an identity of an item within one or more of the at least one storage region. In some embodiments, at least one sensor may include a temperature sensor, such as, for example, chemical sensors, thermometers, bimetallic strips, or thermocouples. An substantially thermally sealed container may include one or more sensors such as a physical sensor component such as described in U.S. Pat. No. 6,453,749 to Petrovic et al., titled "Physical sensor component," which is herein incorporated by reference. An substantially thermally sealed container may include one or more sensors such as a pressure sensor such as described in U.S. Pat. No. 5,900,554 to Baba et al., titled "Pressure sensor," which is herein incorporated by reference. An substantially thermally sealed container may include one or more sensors such as a vertically integrated sensor structure such as described in U.S. Pat. No. 5,600,071 to Sooriakumar et al., titled "Vertically integrated sensor structure and method," which is herein incorporated by reference. An substantially thermally sealed container may include one or more sensors such as a system for determining a quantity of liquid or fluid within a container, such as described in U.S. Pat. No. 5,138,559 to Kuehl et al., titled "System and method for measuring liquid mass quantity," U.S. Pat. No. 6,050,598 to Upton, titled "Apparatus for and method of monitoring the mass quantity and density of a fluid in a closed container, and a vehicular air bag system incorporating such apparatus," and U.S. Pat. No. 5,245,869 to Clarke et al., titled "High accuracy mass sensor for monitoring fluid quantity in storage tanks," which are each herein incorporated by reference. An substantially thermally sealed container may include one or more sensors of radio frequency identification ("RFID") tags to identify material within the at least one substantially thermally sealed storage region. RFID tags are well known in the art, for example in U.S. Pat. No. 5,444,223 to Blama, titled "Radio frequency identification tag and method," which is herein incorporated by reference.

In some embodiments, a substantially thermally sealed container may include one or more communications devices. The one or more communications devices, may include, for example, one or more recording devices, one or more transmission devices, one or more display devices, or one or more receivers. Communications devices may include, for example, communication devices that allow a user to detect information about the container visually, auditorily, or via signal to a remote device. Some embodiments may include communications devices on the exterior of the container, including devices attached to the exterior of the container, devices adjacent to the exterior of the container, or devices located at a distance from the exterior of the container. Some embodiments may include communications devices located within the structure of the container. Some embodiments may include communications devices located within at least one of the one or more substantially thermally sealed storage regions. Some embodiments may include at least one display device located at a distance from the container, for example a display located at a distance operably linked to at least one sensor. Some embodiments may include more than one type of communications device, and in some embodiments the devices may be operably linked. For example, some embodiments may contain both a receiver and an operably linked transmission device, so that a signal may be received by the receiver which then causes a transmission to be made from the transmission device. Some embodiments may include more than one type of communications device that are not operably linked. For example, some embodiments may include a transmission device and a display device, wherein the transmission device is not linked to the display device.

In some embodiments, a substantially thermally sealed storage container includes at least one authentication device, wherein the at least one authentication device may be operably connected to an aperture in the outer wall of the container. In some embodiments, a substantially thermally sealed storage container includes at least one authentication device, wherein the at least one authentication device may be operably connected to at least one externally-operable opening, control egress device, communications device, or other component. For example, an authentication device may include a device which may be authenticated with a key, or a device that may be authenticated with a code, such as a password or a combination. For example, an authentication device may include a device that may be authenticated using biometric parameters, such as fingerprints, retinal scans, hand spacing, voice recognition or biofluid composition (e.g. blood, sweat, or saliva).

In some embodiments, a substantially thermally sealed storage container includes at least one logging device. A logging device may be operably connected to an aperture in the outer wall of the container. In some embodiments, a substantially thermally sealed storage container includes at least one logging device, wherein the at least one logging device may be operably connected to at least one externally-operable opening, control egress device, communications device, or other component. The at least one logging device may be configured to log information desired by a user. For example, a logging device may include a record of authentication via the authentication device, such as a record of times of authentication, operation of authentication or individuals making the authentication. For example, a logging device may record that an authentication device was authenticated with a specific code which identifies a specific individual at one or more specific times. For example, a logging device may record egress of a quantity of a material from at least one storage region, such as recording that some quantity or units of material egressed at a specific time. For example, a logging device may record information from one or more sensors, one or more temperature indicators, or one or more communications devices.

In some embodiments an substantially thermally sealed container may include one or more recording devices. The one or more recording devices may include devices that are magnetic, electronic, chemical, or transcription based recording devices. One or more recording device may be located within at least one substantially thermally sealed storage region, one or more recording device may be located exterior to the container, or one or more recording device may be located within the structure of the container. The one or more recording device may record, for example, the temperature from one or more temperature sensor, data or information from one or more temperature indicator, or the gaseous pressure, mass, volume or identity of an item information from at least one sensor within the at least one storage region. In some embodiments, the one or more recording devices may be integrated with one or more sensor. For example, in some embodiments there may be one or more temperature sensors which record the highest, lowest or average temperature detected. For example, in some embodiments, there may be one or more mass sensors which record one or more mass changes within the container over time. For example, in some embodiments, there may be one or more gaseous pressure sensors which record one or more gaseous pressure changes within the container over time.

In some embodiments an substantially thermally sealed container may include one or more transmission device. One or more transmission device may be located within at least one substantially thermally sealed storage region, one or more transmission device may be located exterior to the container, or one or more transmission device may be located within the structure of the container. The one or more transmission device may transmit any signal or information, for example, the temperature from one or more temperature sensor, or the gaseous pressure, mass, volume or identity of an item or information from at least one sensor within the at least one storage region. In some embodiments, the one or more transmission device may be integrated with one or more sensor, or one or more recording device. The one or more transmission devices may transmit by any means known in the art, for example, but not limited to, via radio frequency (e.g. RFID tags), magnetic field, electromagnetic radiation, electromagnetic waves, sonic waves, or radioactivity.

In some embodiments, a substantially thermally sealed container may include one or more receivers. For example, one or more receivers may include devices that detect sonic waves, electromagnetic waves, radio signals, electrical signals, magnetic pulses, or radioactivity. Depending on the embodiment, one or more receiver may be located within one or more of the at least one substantially thermally sealed storage region. In some embodiments, one or more receivers may be located within the structure of the container. In some embodiments, the one or more receivers may be located on the exterior of the container. In some embodiments, the one or more receiver may be operably coupled to another device, such as for example one or more display devices, recording devices or transmission devices. For example, a receiver may be operably coupled to a display device on the exterior of the container so that when an appropriate signal is received, the display device indicates data, such as time or temperature data. For example, a receiver may be operable coupled to a transmission device so that when an appropriate signal is received, the transmission device transmits data, such as location, time, or positional data.

EXAMPLES

Example 1

Fabrication of a Flexible Connector

Figure 10:
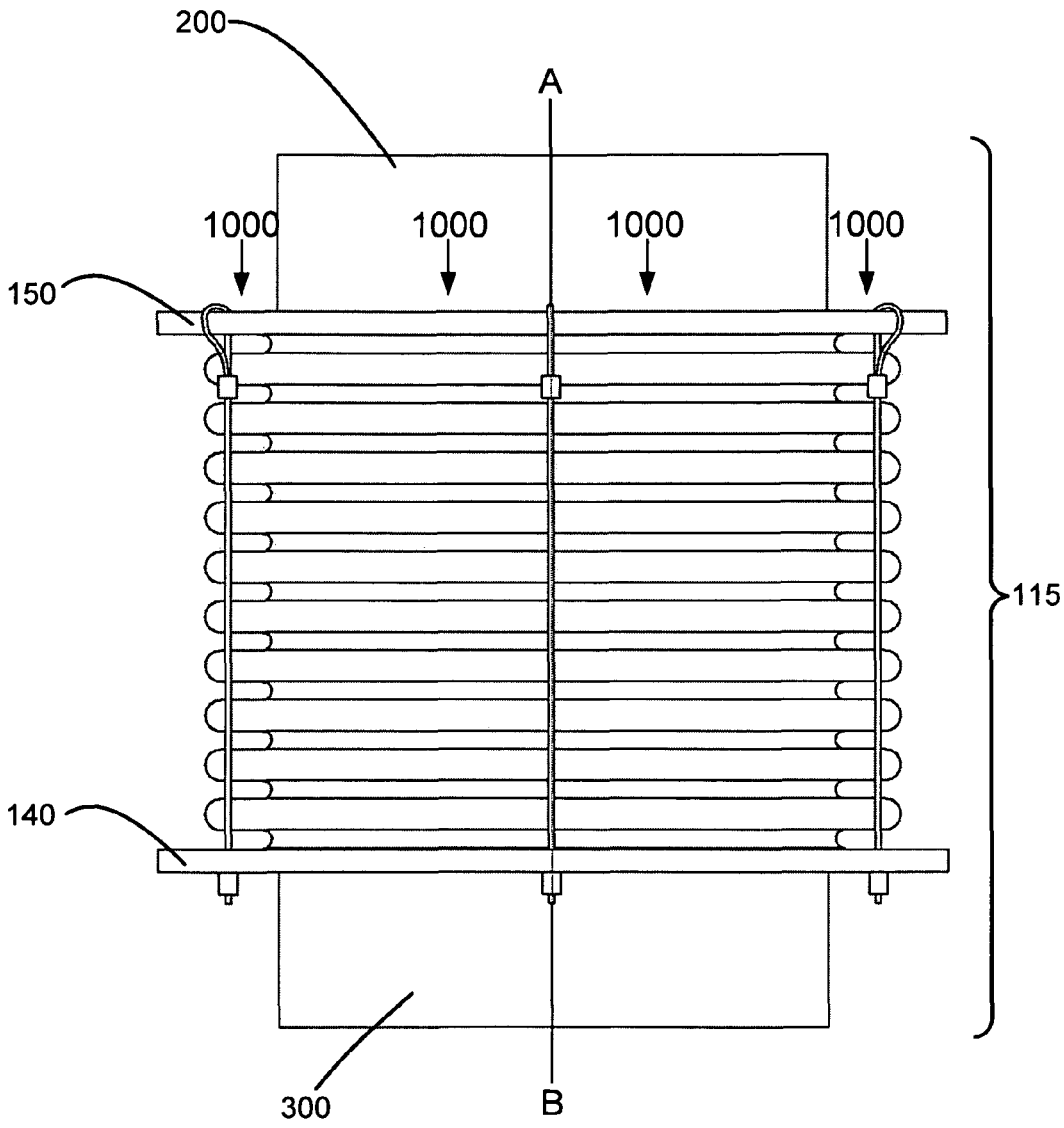
FIG. 10 depicts an external side view of a flexible connector.

A flexible connector, similar to that illustrated in FIGS. 3 through 7, was fabricated prior to incorporation into a substantially thermally sealed storage container as follows. FIG. 10 illustrates aspects of the fabrication of a flexible connector 115.

A duct of 5 inches in length and fabricated in stainless steel was obtained from Ameriflex Inc., (Corona, Calif.). The duct was approximately 5 inches in total length prior to incorporation in the flexible connector. The duct included a central "bellows" region including approximately 10 corrugated folds at right angles to the central axis of the conduit formed by the duct. When the flexible connector is used in a substantially upright container (e.g. see FIG. 1), the corrugated folds are in a substantially horizontal position. This positioning is illustrated, for example, in FIGS. 1, 4, 5 and 10. The conduit formed by the duct is approximately three inches in diameter. The bellows region was fabricated from 0.008 inch thick US SAE 304 stainless steel. The duct also included circular end regions on either end of the bellows region. FIG. 10 depicts the first end region as 200 and the second end region as 300. The end regions were both one inch long and created a conduit with an interior diameter of three inches. The end regions were both fabricated from US SAE 316 stainless steel with a 0.065 inch thickness.

Two compression units were fabricated to substantially encircle each end region of the duct and to be adjacent to the bellows region of the duct when the flexible connector was assembled. Each compression unit was a disk-like structure with a central aperture configured to encircle an end region of the duct. See FIGS. 6 and 7 for an example. The total diameter of each compression unit from outer edge to outer edge across the disk-like structure was approximately 4.3 inches. Each compression unit was fabricated from 0.125 inch thick US SAE 304 stainless steel. Each compression unit had six circular holes drilled around the outer edge of the unit at approximately equal intervals. The holes were each approximately 0.04 inches in diameter and placed approximately 0.25 inches from the outer edge of the ring formed by the disk-like structure of the compression unit.

Six wire ropes were used as compression strands to connect the first compression unit to the second compression unit. The compression units were connected in a substantially parallel orientation, with the wire ropes at right angles to the compression units. Each of the wire ropes was a 1×7 strand rope of approximately 0.03 inch diameter fabricated from US SAE 304 stainless steel. Each wire rope was rated to a break strength of 150 pounds by the manufacturer.

To assemble the flexible connector, the first compression unit was placed around the first end of the duct, and the second compression unit was placed around the second end of the duct. FIG. 10 illustrates the first compression unit 150 encircling the first end region of the duct 200 and the second compression unit 140 encircling the second end region of the duct 300. The relative holes on the outer edges of the compression units were aligned relative to each other in matching pairs. The second compression unit was held stable relative to the second end of the duct. The duct was compressed by evenly applied pressure along the planar surface of the first compression unit at right angles to the central axis of the conduit formed by the duct. Vector lines illustrating the direction of this pressure force are depicted as 1000 in FIG. 10. The compression pressure maintained the first compression unit and the second compression unit in a substantially parallel position relative to each other, with the central axis of the conduit formed by the duct perpendicular to the plane of the first compression unit and the second compression unit (i.e. along the axis between "A" and "B" as marked in FIG. 10, or substantially along the axis between any given matching pairs of holes in the first compression unit and the second compression unit). The duct was compressed by approximately 0.15 inches, so that the entire length of the compressed duct was reduced from 5 inches to approximately 4.85 inches. The compression was maintained until the wire ropes were fixed in position, at which time tension from the wire ropes served to compress the duct length. The wire ropes were positioned through each of the matching pairs of holes in the first compression unit and the second compression unit. The wires were positioned in a substantially parallel position relative to the central axis of the conduit formed by the duct. Adjacent to the surface of the second compression unit, a US SAE 304 oval crimp sleeve was attached to each wire rope. At the first compression unit, the end of each wire rope was looped around the outer edge of the compression unit and attached to itself approximately 0.125 inches from the surface of the first compression unit facing the bellows region. The wire rope was attached to itself using a US SAE 304 oval crimp sleeve crimped on to the wire rope.

After assembly, the flexible connector had a total length of approximately 4.85 inches and formed an internal conduit of approximately three inches in diameter. A total of six wire ropes were positioned at equal intervals connecting the first compression unit to the second compression unit. The wire ropes were substantially parallel to the internal conduit formed by the flexible connector. Although the wire ropes were substantially parallel to the internal conduit formed by the flexible connector, a small deformation of the wire ropes inward towards the duct was formed by the crimping of the crimp sleeves and associated tension on the wire ropes. The first compression unit and the second compression unit were substantially parallel to each other and substantially perpendicular to the internal conduit formed by the flexible connector.

Example 2

Testing the Load Bearing Capacity of a Flexible Connector

A flexible connector was tested to establish its load bearing ability in an orientation substantially along the length of the internal conduit formed by the flexible connector. This is the expected orientation of a flexible connector relative to the storage region when the container is in an upright position (e.g. see FIG. 1).

Two stainless steel compression units were connected with six stainless steel wire ropes as described in Example 1, only without the duct included in the structure. For purposes of testing, two compression units were connected with six wire ropes as described in Example 1, in the absence of a duct. For purposes of testing, two compression units and the set of compression strands connecting the compression units were used to approximate a complete flexible connector. The two compression units were positioned at the same approximate distance from each other as they would during fabrication of a flexible connector, as described in Example 1 (i.e. approximately 2.85 inches apart). The first compression unit was fixed to a stainless steel plate suspended from an industrial scale. A second stainless steel plate was attached to the second compression unit, with a steel chain suspended downward from the second steel plate. Weights were added steel chain suspended downward from the second steel plate in increasing increments, and the total mass suspended was evaluated using the reading of the industrial scale. Weights continued to be added until the wire ropes came apart. For a total of 6 stainless steel 1×7 strand ropes of approximately 0.03 inch diameter fabricated from US SAE 304 stainless steel, the failure point was determined as approximately 800 pounds. The crimp connections held firm and did not come apart during testing. On the basis of this test, it was estimated that a similarly-fabricated flexible neck unit installed within a substantially thermally sealed container would have the capacity to support approximately 800 pounds from a combination of the inner wall, the contents of the storage structure, and any net force from a partial pressure within a gap when the container is in an upright configuration.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A substantially thermally sealed storage container, comprising:

an outer wall;

an inner wall at least partially defining a substantially sealed thermal storage region within the container, the inner wall spaced from the outer wall by a gap;

a flexible connector joining an aperture in an exterior of a substantially thermally sealed storage container to an aperture in the substantially thermally sealed storage region, wherein the flexible connector includes;

a duct forming an elongated thermal pathway between the exterior of the container and the substantially thermally sealed storage region, the duct substantially defining a conduit between the exterior of the substantially thermally sealed storage container and the aperture in the substantially thermally sealed storage region, the duct including an inner surface adjacent to the conduit and an outer surface adjacent to an interior of the container, a first compression unit configured to mate with a first end of the duct, a second compression unit configured to mate with a second end of the duct, and a plurality of compression strands connected between the first compression unit and the second compression unit, the plurality of compression strands positioned adjacent to the outer surface of the duct; and a restriction unit including, a rod extending from an interior surface of the outer wall and being spaced from the inner wall by a gap therebetween; and a restriction component extending from an exterior surface of the inner wall, the restriction component at least partially surrounding the rod to limit lateral movement of the rod with respect to the restriction component, the restriction component being spaced from the rod by a standoff distance at least when the container is in an upright position.

2. The substantially thermally sealed storage container of claim 1, wherein the container is configured for the aperture in the exterior of the container to be positioned at a top of the container during use of the container.

3. The substantially thermally sealed storage container of claim 1, wherein the flexible connector is flexible along its vertical axis relative to an upright position of the container.

4. The substantially thermally sealed storage container of claim 1, wherein the flexible connector is configured to completely support a mass of the substantially thermally sealed storage region and material stored within the substantially thermally sealed storage region while the container is in an upright position.

5. The substantially thermally sealed storage container of claim 1, wherein the container is configured for the aperture in the exterior of the container to be at top of the container during storage.

6. The substantially thermally sealed storage container of claim 1, wherein the duct is fabricated from stainless steel.

7. The substantially thermally sealed storage container of claim 1, wherein the duct forming an elongated thermal pathway comprises:

a plurality of corrugated folds positioned at right angles to a central axis of the conduit.

8. The substantially thermally sealed storage container of claim 1, wherein the first compression unit substantially encircles the first end of the duct, and wherein the second compression unit substantially encircles the second end of the duct.

9. The substantially thermally sealed storage container of claim 1, wherein the first compression unit is fabricated from stainless steel, and wherein the second compression unit is fabricated from stainless steel.

10. The substantially thermally sealed storage container of claim 1, wherein the plurality of compression strands are fabricated from stainless steel.

11. The substantially thermally sealed storage container of claim 1, wherein the plurality of compression strands comprise:

at least six compression strands positioned at approximately equal intervals around a circumference of the duct.

12. The substantially thermally sealed storage container of claim 1, comprising:

a gas-impermeable junction between the first end of the duct and the exterior of the substantially thermally sealed storage container, the gas-impermeable junction substantially encircling the aperture in the exterior of the container, and a gas-impermeable junction between the second end of the duct and the substantially thermally sealed storage region, the gas-impermeable junction substantially encircling the aperture in the substantially thermally sealed storage region.

13. The substantially thermally sealed storage container of claim 1, wherein the flexible connector has sufficient flexibility to reversibly flex within the gap.

14. The substantially thermally sealed storage container of claim 1, comprising:

at least one junction unit.

15. The substantially thermally sealed storage container of claim 1, comprising:

at least one sensor operably attached to the container.

16. The substantially thermally sealed storage container of claim 1, comprising:

at least one temperature indicator.

17. A substantially thermally sealed storage container, comprising:

an outer wall substantially defining a substantially thermally sealed storage container, the outer wall substantially defining a single outer wall aperture;

an inner wall substantially defining a substantially thermally sealed storage region within the substantially thermally sealed storage container, the inner wall substantially defining a single inner wall aperture;

a gap between the inner wall and the outer wall;

at least one section of ultra efficient insulation material within the gap;

a flexible connector joining the single outer wall aperture and the single inner wall aperture, wherein the flexible connector includes a duct substantially defining a conduit including an extended thermal pathway, the duct including an inner surface adjacent to the conduit and an outer surface adjacent to the gap, a first compression unit configured to mate with a first end of the duct, a second compression unit configured to mate with a second end of the duct, and a plurality of compression strands connected between the first compression unit and the second compression unit, the plurality of compression strands positioned adjacent to the outer surface of the duct; and a plurality of restriction units positioned within the gap, at least some of the plurality of restrictions units including rods positioned about an interior lateral surface of the outer wall and configured to limit lateral movement of the inner wall relative to the outer wall.

18. The substantially thermally sealed storage container of claim 17, wherein the outer wall is fabricated from stainless steel.

19. The substantially thermally sealed storage container of claim 17, wherein the outer wall is fabricated from aluminum.

20. The substantially thermally sealed storage container of claim 17, wherein the container is configured so that the single outer wall aperture is positioned at a top of the container during use of the container.

21. The substantially thermally sealed storage container of claim 17, wherein the inner wall is fabricated from stainless steel.

22. The substantially thermally sealed storage container of claim 17, wherein the inner wall is fabricated from aluminum.

23. The substantially thermally sealed storage container of claim 17, wherein the gap between the inner wall and the outer wall comprises:

substantially evacuated space having a pressure less than or equal to $5\times10^{-4}$ torr.

24. The substantially thermally sealed storage container of claim 17, wherein the gap between the inner wall and the outer wall comprises:

a plurality of layers of multilayer insulation material; and substantially evacuated space having a pressure less than or equal to $5\times10^{-4}$ torr.

25. The substantially thermally sealed storage container of claim 17, wherein the flexible connector is flexible along its vertical axis relative to an upright position of the container.

26. The substantially thermally sealed storage container of claim 17, wherein the flexible connector has a capacity to reversibly flex to a degree required for the inner wall to be positioned adjacent to the outer wall.

27. The substantially thermally sealed storage container of claim 17, wherein the flexible connector is configured to support the mass of the inner wall and total contents of the substantially thermally sealed storage region as well as the net force on the inner wall from a pressure less than or equal to $5\times10^{-4}$ torr in the gap.

28. The substantially thermally sealed storage container of claim 17, wherein the flexible connector is configured to completely support the mass of the inner wall and total contents of the substantially thermally sealed storage region while the container is in an upright position.

29. The substantially thermally sealed storage container of claim 17, wherein the duct includes a plurality of concavities positioned at right angles to a central axis of the conduit, the plurality of concavities forming an extended thermal pathway between the inner wall and the outer wall.

30. The substantially thermally sealed storage container of claim 17, wherein the duct is fabricated from stainless steel.

31. The substantially thermally sealed storage container of claim 17, wherein the first compression unit is fabricated from stainless steel and wherein the second compression unit is fabricated from stainless steel.

32. The substantially thermally sealed storage container of claim 17, wherein the first compression unit substantially encircles the first end of the duct, and wherein the second compression unit substantially encircles the second end of the duct.

33. The substantially thermally sealed storage container of claim 17, wherein the plurality of compression strands are fabricated from stainless steel.

34. The substantially thermally sealed storage container of claim 17, wherein the plurality of compression strands comprise:

at least six compression strands positioned at approximately equal intervals around a circumference of the duct.

35. The substantially thermally sealed storage container of claim 17, comprising:

a gas-impermeable junction between the first end of the duct and the outer wall at the edge of the single outer wall aperture, and a gas-impermeable junction between the second end of the duct and the inner wall at the edge of the single inner wall aperture.

36. The substantially thermally sealed storage container of claim 17, wherein one of the plurality of restriction units is disposed within the gap below the substantially sealed thermal storage region.

37. The substantially thermally sealed storage container of claim 17, comprising:

at least one sensor.

38. The substantially thermally sealed storage container of claim 17, comprising:

at least one temperature indicator.

39. The substantially thermally sealed storage container of claim 17, comprising:

at least one junction unit.

40. The substantially thermally sealed storage container of claim 17, comprising:

a storage structure within the substantially thermally sealed storage region.

41. A substantially thermally sealed storage container, comprising:

an outer wall substantially defining a substantially thermally sealed storage container, the outer wall substantially defining a single outer wall aperture;

an inner wall substantially defining a substantially thermally sealed storage region within the substantially thermally sealed storage container, the inner wall substantially defining a single inner wall aperture;

a gap between the inner wall and the outer wall, the gap with a heat leak of less than 1 Watt between the substantially thermally sealed storage region maintained at a temperature between 0 degrees C. and 10 degrees C. and the exterior of the container at a temperature of approximately 40 degrees Centigrade;

at least one layer of multilayer insulation material within the gap, the at least one layer of multilayer insulation material substantially surrounding the inner wall;

a pressure less than or equal to $5\times10^{-4}$ torr in the gap;

a plurality of thermally non-conductive strands, each with ends attached to an interior surface of the outer wall adjacent to the gap and center regions extending around a surface of the inner wall adjacent to the gap thereby limiting movement of the inner wall with respect to the outer wall; and a flexible connector joining the single outer wall aperture and the single inner wall aperture, wherein the flexible connector includes, a duct substantially defining a conduit including an extended thermal pathway, the duct including an inner surface adjacent to the conduit and an outer surface adjacent to an interior of the container, a first compression unit configured to mate with a first end of the duct, a second compression unit configured to mate with a second end of the duct, and a plurality of compression strands connecting the first compression unit and the second compression unit, the plurality of compression strands positioned adjacent to the outer surface of the duct.

42. The substantially thermally sealed storage container of claim 41, wherein the outer wall and the inner wall are fabricated from stainless steel.

43. The substantially thermally sealed storage container of claim 41, wherein the container is configured so that the single outer wall aperture is positioned at a top of the container during use of the container.

44. The substantially thermally sealed storage container of claim 41, wherein the flexible connector is flexible along its vertical axis relative to an upright position of the container.

45. The substantially thermally sealed storage container of claim 41, wherein the flexible connector has a capacity to reversibly flex to a degree required for the inner wall to be positioned adjacent to the outer wall.

46. The substantially thermally sealed storage container of claim 41, wherein the flexible connector is configured to support the mass of the inner wall and contents of the substantially thermally sealed storage region as well as a net force on the inner wall from the pressure less than or equal to $5\times10^{-4}$ torr in the gap.

47. The substantially thermally sealed storage container of claim 41, wherein the flexible connector is configured to completely support the inner wall and total contents of the substantially thermally sealed storage region while the container is in an upright position.

48. The substantially thermally sealed storage container of claim 41, wherein the duct is fabricated from stainless steel.

49. The substantially thermally sealed storage container of claim 41, wherein the duct includes a plurality of concavities positioned at right angles to a central axis of the conduit, the plurality of concavities forming an extended thermal pathway between the inner wall and the outer wall.

50. The substantially thermally sealed storage container of claim 41, wherein the first compression unit and the second compression unit are fabricated from stainless steel.

51. The substantially thermally sealed storage container of claim 41, comprising:

a first gas-impermeable junction between the first end of the duct and the outer wall, the first gas-impermeable junction substantially encircling the single outer wall aperture; and a second gas-impermeable junction between the second end of the duct and the inner wall, the second gas-impermeable junction substantially encircling the single inner wall aperture.

52. The substantially thermally sealed storage container of claim 41, comprising:

at least one restriction unit within the gap, the at least one restriction unit including a rod extending from the interior surface of the outer wall toward the inner wall and a gap between the inner wall and the rod when in the substantially thermally sealed storage container is in an upright position.

53. The substantially thermally sealed storage container of claim 41, comprising:

at least one junction unit.

54. The substantially thermally sealed storage container of claim 1, wherein the central rod unit includes a circular top flange extending laterally therefrom and the restriction component surrounds a top surface, a side surface and at least a portion of the lower surface of the circular top flange.

* * * * *

UNITED STATES PATENT AND TRADEMARK OFFICE

CERTIFICATE OF CORRECTION

PATENT NO. : 9,139,351 B2
APPLICATION NO. : 12/927981
DATED : September 22, 2015
INVENTOR(S) : Deane Chou et al.

It is certified that error appears in the above-identified patent and that said Letters Patent is hereby corrected as shown below:

In the claims

Column 34, Lines 33-35, Claim 52:
"...between the inner wall and the rod when in the substantially thermally sealed storage container is in an upright position" should be:

--...between the inner wall and the rod when the substantially thermally sealed storage container is in an upright position.--

Signed and Sealed this
First Day of March, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,139,351 B2
APPLICATION NO. : 12/927981
DATED : September 22, 2015
INVENTOR(S) : Chou et al.

It is certified that error appears in the above-identified patent and that said Letters Patent is hereby corrected as shown below:

This certificate supersedes the Certificate of Correction issued March 1, 2016. The certificate is vacated since the request for the Certificate of Correction filed did not include a signed paper in compliance with 37 CFR 1.33. There was no statement stating the root cause of error and Office should not have acted on the request. The Certificate of Correction which issued March 1, 2016, was published in error and should not have been issued for this patent.

Signed and Sealed this
Twelfth Day of April, 2016

Michelle K. Lee

Michelle K. Lee
*Director of the United States Patent and Trademark Office*